US008783805B2

(12) United States Patent
Uchino

(10) Patent No.: US 8,783,805 B2
(45) Date of Patent: Jul. 22, 2014

(54) LIQUID EJECTION APPARATUS, CONTROL METHOD FOR THE SAME, AND COMPUTER-READABLE STORAGE MEDIUM

(71) Applicant: Shunji Uchino, Nagoya (JP)

(72) Inventor: Shunji Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/039,057

(22) Filed: Sep. 27, 2013

(65) Prior Publication Data

US 2014/0092154 A1 Apr. 3, 2014

(30) Foreign Application Priority Data

Sep. 28, 2012 (JP) ..... 2012-218151

(51) Int. Cl.
*B41J 29/38* (2006.01)

(52) U.S. Cl.
USPC ..... 347/9; 347/5; 347/10

(58) Field of Classification Search
USPC ..... 347/5, 9, 10, 11, 12
See application file for complete search history.

(56) References Cited

U.S. PATENT DOCUMENTS 6,523,922 B2 * 2/2003 Hirayama ..... 347/9
7,530,653 B2 * 5/2009 Hirayama ..... 347/9

FOREIGN PATENT DOCUMENTS

JP 2000-203018 A 7/2000

* cited by examiner

*Primary Examiner* — Lam S Nguyen
(74) *Attorney, Agent, or Firm* — Banner & Witcoff, Ltd.

(57) ABSTRACT

A liquid ejection apparatus includes a liquid ejection head, actuator units with actuators, a power supply that output a main voltage, and linear regulators that reduce the main voltage to drive voltages to be supplied to the relevant actuator units. When a voltage difference between the main voltage and drive voltage is greater than an allowable value for any of the actuator units, the apparatus controls a linear regulator so that the drive voltage supplied to at least one actuator unit is adjusted to a high drive voltage. A small ejection driving waveform is created as the driving waveform to be output to the actuators in the actuator unit to which the high drive voltage is supplied.

10 Claims, 10 Drawing Sheets

NON-EJECTION
t

SMALL LIQUID
DROPLET EJECTION
t

MEDIUM LIQUID
DROPLET EJECTION
t

LARGE LIQUID
DROPLET EJECTION
t
PRINTING CYCLE

VALUES IN PARENTHESES ARE VALUES BEFORE ADJUSTMENT.

LIQUID EJECTION APPARATUS, CONTROL METHOD FOR THE SAME, AND COMPUTER-READABLE STORAGE MEDIUM

CROSS REFERENCE TO RELATED APPLICATION

This application claims priority from Japanese Patent Application No. 2012-218151, filed on Sep. 28, 2012, which is incorporated herein by reference.

FIELD OF DISCLOSURE

The disclosure herein relates to a liquid ejection apparatus, a method of controlling the liquid ejection apparatus, and a computer-readable storage medium for controlling liquid ejection.

BACKGROUND

A known printing head voltage controller lowers a main voltage output from a switching power supply apparatus by using a printing head voltage control circuit to obtain driving voltages on which a plurality of printing heads operate. This type of voltage controller uses an inexpensive three-terminal regulator in the printing head voltage control circuit. To obtain a stable output, a voltage difference between the IN terminal and OUT terminal of the three-terminal regulator is set to a fixed voltage (1.5 V, for example) or higher.

BRIEF SUMMARY

If the voltage difference between the IN terminal and OUT terminal becomes too large, too much heat is generated by the three-terminal regulator, so the circuit of the three-terminal regulator may deteriorate. Conversely, if the voltage difference is limited to a certain value, another problem occurs. In a range in which the certain value is exceeded, head driving voltages are not appropriately set, so the image quality of an image recorded by the heads may be lowered.

In view of the situation described above, aspects of the disclosure relate to a liquid ejection apparatus that may prevent linear regulators from deteriorating due to heat and can also suppress deterioration of the image quality of an image recorded on a recording medium, as well as a method of controlling the liquid ejection apparatus and a computer-readable storage medium.

In one aspect, a liquid ejection apparatus disclosed herein may comprise a liquid ejection head, a storage device, a power supply, a plurality of linear regulators and a control device. The liquid ejection head may include a plurality of ejection openings from which a liquid used to record an image on a recording medium is ejected, and a plurality of actuators, each of which corresponds to one of the plurality of ejection openings, each actuator may be configured to eject the liquid from the ejection opening corresponding to each actuator. The storage device may be configured to store image data related to the image to be recorded on the recording medium. The power supply may be configured to output a main voltage. Each of the plurality of linear regulators corresponds to one of a plurality of actuator units, and each may have at least one actuator of the plurality of actuators. Each linear regulator may be configured to reduce the main voltage output from the power supply to a drive voltage used by the actuator unit corresponding to each linear regulator and supply the drive voltage to the corresponding actuator unit. The control device may be configured to calculate, for each of the plurality of actuator units, a viscosity of the liquid in the plurality of ejection openings corresponding to the plurality of actuators, which is at least one actuator, included in each of the plurality of actuator units. The control device may also be configured to determine, for each of the plurality of actuator units, the drive voltage which is output to the corresponding actuator unit, based on the viscosity of the liquid. The control device may also be configured to judge, for each of the plurality of actuator units, whether a voltage difference between the drive voltage and the main voltage is greater than a first value.

The control device may also be configured to adjust, for each of the plurality of actuator units, when the voltage difference is greater than the first value, the drive voltage to a high drive voltage, which is a drive voltage higher than the drive voltage, in order to reduce the voltage difference equal to or lower than the first value. The control device may also be configured to create a plurality of different types of driving waveforms based on the image data, each driving waveform having a voltage level corresponding to the drive voltage of the actuator unit in which the plurality of actuators are included, different amounts of liquid being ejected from the plurality of ejection openings corresponding to the plurality of actuators according to the different types of driving waveforms. The control device may also be configured to create a small ejection driving waveform, which is one of the plurality of different types of driving waveforms, to be output to the actuator included in the actuator unit, among the plurality of actuator units, for which the drive voltage is adjusted to the high drive voltage, the small ejection driving waveform being used to eject a smaller amount of liquid than an amount of liquid ejected based on the driving waveforms created from the image data. The control device may also be configured to control the plurality of linear regulators to supply the drive voltage or the high drive voltage to the plurality of actuator units. The control device may also be configured to output the plurality of different types of driving waveforms to each of the plurality of actuators.

In another aspect, a method disclosed herein may be performed with a liquid ejection apparatus. The liquid ejection apparatus disclosed herein may comprise a liquid ejection head, a storage device, a power supply, and a plurality of linear regulators. The liquid ejection head may include a plurality of ejection openings from which a liquid used to record an image on a recording medium is ejected, and a plurality of actuators, each of which corresponds to one of the plurality of ejection openings, wherein each actuator may be configured to eject the liquid from the ejection opening corresponding to each actuator. The storage device may be configured to store image data related to the image to be recorded on the recording medium. The power supply may be configured to output a main voltage. The plurality of linear regulators, each of which corresponds to one of a plurality of actuator units, may have at least one actuator of the plurality of actuators. Each linear regulator may be configured to reduce the main voltage output from the power supply to a drive voltage used by the actuator unit corresponding to each linear regulator and supply the drive voltage to the corresponding actuator unit. The method may comprise a step of calculating, for each of the plurality of actuator units, a viscosity of the liquid in the plurality of ejection openings corresponding to the plurality of actuators, which is at least one actuator, included in each of the plurality of actuator units. The method may also comprise a step of determining, for each of the plurality of actuator units, the drive voltage which is output to the corresponding actuator unit based on the viscosity of the liquid. The method may also comprise a step of judging, for each of the plurality of actuator units, whether a voltage difference between the drive voltage and the main voltage is greater than a first value. The method may also comprise a step of adjusting, for each of the plurality of actuator units, when the voltage difference is greater than the first value, the drive voltage to a high drive voltage, which is a drive voltage higher than the drive voltage, in order to reduce the voltage difference equal to or lower than the first value. The method may also comprise a step of creating a plurality of different types of driving waveforms based on the image data, each driving waveform having a voltage level corresponding to the drive voltage of the actuator unit in which the plurality of actuators are included, different amounts of liquid being ejected from the plurality of ejection openings corresponding to the plurality of actuators according to the different types of driving waveforms. The method may also comprise a step of creating a small ejection driving waveform, which is one of the plurality of different types of driving waveforms to be output to the actuator included in the actuator unit among the plurality of actuator units for which the drive voltage is adjusted to the high drive voltage. The small ejection driving waveform being used to eject a smaller amount of liquid than an amount of liquid ejected based on the driving waveforms created from the image data. The method may also comprise a step of controlling the plurality of linear regulators to supply the drive voltage or the high drive voltage to the plurality of actuator units. The method may also comprise a step of outputting the plurality of different types of driving waveforms to each of the plurality of actuators.

In yet another aspect, a non-transitory computer-readable storage medium stores computer-readable instructions therein. When executed by at least one processor of a liquid ejection apparatus, the computer-readable instructions may instruct the liquid ejection apparatus to execute certain steps. The liquid ejection apparatus disclosed herein may comprise a liquid ejection head, a storage device, a power supply, and a plurality of linear regulators. The liquid ejection head may include a plurality of ejection openings from which a liquid used to record an image on a recording medium is ejected and a plurality of actuators, each of which corresponds to one of the plurality of ejection openings. Each actuator may be configured to eject the liquid from the ejection opening corresponding to each actuator. The storage device may be configured to store image data related to the image to be recorded on the recording medium. The power supply may be configured to output a main voltage. Each of the plurality of linear regulators corresponds to one of a plurality of actuator units. Each of the plurality of actuator units may have at least one actuator of the plurality of actuators. Each linear regulator may be configured to reduce the main voltage output from the power supply to a drive voltage used by the actuator unit corresponding to each linear regulator and supply the drive voltage to the corresponding actuator unit. The computer-readable instructions may instruct the liquid ejection apparatus to execute the steps of calculating for each of the plurality of actuator units a viscosity of the liquid in the plurality of ejection openings corresponding to the plurality of actuators, which is at least one actuator, included in each of the plurality of actuator units. The computer-readable instructions may also instruct the liquid ejection apparatus to execute the steps of determining, the drive voltage which is output to the corresponding actuator unit for each of the plurality of actuator units, based on the viscosity of the liquid. The computer-readable instructions may also instruct the liquid ejection apparatus to execute the steps of judging, for each of the plurality of actuator units, whether a voltage difference between the drive voltage and the main voltage is greater than a first value. The computer-readable instructions may also instruct the liquid ejection apparatus to execute the step of adjusting the drive voltage to a high drive voltage for each of the plurality of actuator units when the voltage difference is greater than the first value. The high drive voltage is higher than the drive voltage in order to reduce the voltage difference equal to or lower than the first value. The computer-readable instructions may also instruct the liquid ejection apparatus to execute the steps of creating a plurality of different types of driving waveforms based on the image data. Each driving waveform has a voltage level corresponding to the drive voltage of the actuator unit in which the plurality of actuators are included. Different amounts of liquid being ejected from the plurality of ejection openings correspond to the plurality of actuators according to the different types of driving waveforms. The computer-readable instructions may also instruct the liquid ejection apparatus to execute the step of creating a small ejection driving waveform. The small ejection waveform is one of the plurality of different types of driving waveforms to be output to the actuator included in the actuator unit, among the plurality of actuator units, for which the drive voltage is adjusted to the high drive voltage. The small ejection driving waveform is used to eject a smaller amount of liquid than an amount of liquid ejected based on the driving waveforms created from the image data. The computer-readable instructions may also instruct the liquid ejection apparatus to execute the steps of controlling the plurality of linear regulators to supply the drive voltage or the high drive voltage to the plurality of actuator units. The computer-readable instructions may also instruct the liquid ejection apparatus to execute the steps of outputting the plurality of different types of driving waveforms to each of the plurality of actuators.

In the structure described above, when a voltage difference between the main voltage and the drive voltage is greater than the first value for any of a plurality of actuator units, the voltage difference is made to be smaller than or equal to the first value for all of the plurality of actuator units. Therefore, it is possible to suppress heat generation by the linear regulators. Although a liquid is easily ejected from the ejection openings corresponding to the actuators included in each actuator unit for which the drive voltage is adjusted to a high drive voltage, a small ejection driving waveform is created for the actuator as a driving waveform that drives the actuator. The small ejection driving waveform is used to eject a smaller amount of ink than the amount of ink ejected according to a driving waveform created from image data. Thus, it is possible to suppress deterioration of the image quality of an image formed on a recording medium.

BRIEF DESCRIPTION OF THE DRAWINGS

Some features disclosed herein are illustrated by way of example, and not by way of limitation, in the figures of the accompanying drawings.

DETAILED DESCRIPTION

Example embodiments in which a liquid ejection apparatus is applied as an inkjet printer will be described with reference to the drawings.

Figure 1:
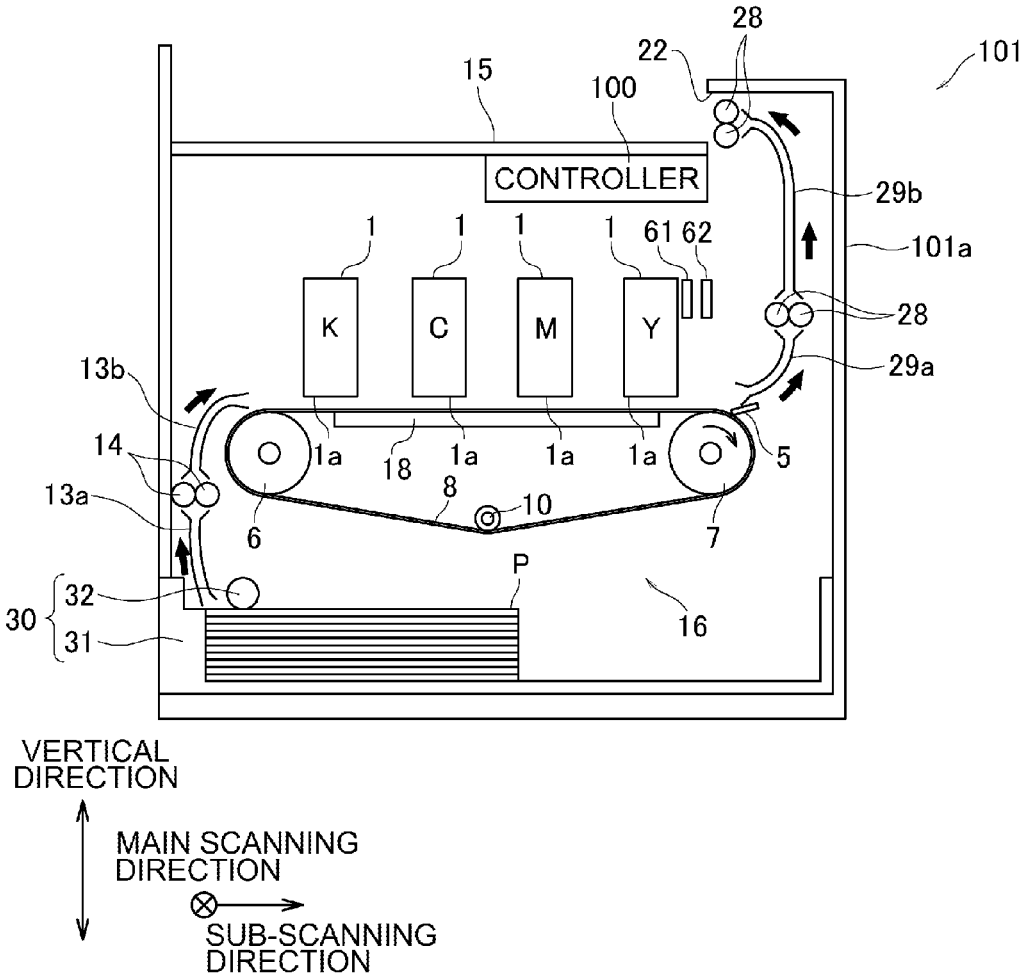
FIG. 1 is a schematic side view illustrating the entire structure of an inkjet printer in an example embodiment according to one or more aspects of the disclosure.

The entire structure of an inkjet printer 101 (simply referred to below as the printer 101) according to a first embodiment will be described first with reference to FIG. 1. The printer 101 has a case 101*a* in a rectangular parallelepiped shape as illustrated in FIG. 1. Four inkjet heads 1 (liquid ejection heads, which will be referred to below as heads 1), which eject ink in magenta, cyan, yellow, and black, and a conveyance mechanism 16 are placed in the case 101*a*. A controller 100 that controls the operation of the heads 1, the conveyance mechanism 16, and the like is attached to the inner surface of the top plate of the case 101*a*. A paper output tray 15 is placed on the upper surface of the top plate. Paper P on which an image has been created is discharged to the paper output tray 15. A paper feed mechanism 30, which can be attached to and detached from the case 101*a*, is placed below the conveyance mechanism 16. Four ink tanks (not shown), which can be attached to and detached from the case 101*a*, are placed below the paper feed mechanism 30. Each of these four tanks stores a different ink. Each head 1 is connected to its corresponding ink tank through a tube (not shown) and a pump 80 (see FIG. 5). The pump 80 is driven to forcibly supply ink to the heads 1 (that is, to perform a purge operation or supply a liquid for the first time). The pump 80 is stopping at all other times, so it does not impede the supplying of ink to the heads 1.

A paper transfer path is formed in the printer 101, as indicated by the thick arrows in FIG. 1. The paper P, which is a type of recording medium, is conveyed from the paper feed mechanism 30 toward the paper output tray 15. The paper feed mechanism 30 has a paper feed tray 31 and a paper feed roller 32. The paper feed tray 31 has a box-like shape with its upper portion being open. A plurality of paper sheets P are stored in the paper feed tray 31 by being stacked. The paper feed roller 32 feeds out the uppermost paper P in the paper feed tray 31. The fed-out paper P is supplied to the conveyance mechanism 16 while being guided by guides 13*a* and 13*b* and being held by a feed roller pair 14.

The conveyance mechanism 16 has a two belt rollers 6 and 7, a conveying belt 8, a tension roller 10, and a platen 18. The conveying belt 8 is an endless belt wound between the rollers 6 and 7. The tension roller 10 is downwardly urged on the lower loop of the conveying belt 8 while in contact with the inner surface of the conveying belt 8, applying tension to the conveying belt 8. The platen 18 is placed in an area inside the conveying belt 8. The platen 18 supports the conveying belt 8 at positions at which the platen 18 faces the heads 1 so that the conveying belt 8 is not downwardly slackened. The belt roller 7, which is a driving roller, rotates clockwise as viewed facing the page of FIG. 1. When the conveying belt 8 runs due to the rotation of the belt roller 7, the belt roller 6, which is a driven roller, rotates clockwise as viewed facing the page of FIG. 1.

A separating plate 5 is provided at a position in which the separating plate 5 faces the belt roller 7. The separating plate 5 separates the paper P from the outer surface of the conveying belt 8. The separated paper P is conveyed while being guided by guides 29*a* and 29*b* and being held by two feed roller pairs 28. The paper P is then discharged from a discharge port 22 formed at the top of the case 101*a* to the paper output tray 15.

Each of the four heads 1 ejects a different color (magenta, yellow, cyan, or black) ink. The four heads 1 have a substantially rectangular parallelepiped shape that is elongated in the main scanning direction. The four heads 1 are secured side by side in a direction in which the conveyance mechanism 16 conveys the paper P. That is, the printer 101 is a line printer. In FIG. 1, the sub-scanning direction is a direction that is parallel to a horizontal plane and is also parallel to the direction in which the paper P is conveyed by the conveyance mechanism 16, and the main scanning direction is a direction that is parallel to a horizontal plane and is orthogonal to the sub-scanning direction.

An ejection surface 1*a* is formed at the bottom of each head 1. A plurality of ejection openings 108 (see FIGS. 3A and 3B), from which ink is ejected, are formed in the ejection surface 1*a*. When the paper P conveyed by the conveyance mechanism 16 passes below the four heads 1, inks in the four colors are ejected sequentially from the ejection openings 108 toward the upper surface of the paper P forming a desired color image on the paper P.

A temperature sensor 61 and a humidity sensor 62 are placed slightly downstream of the head 1 that is located at the downstream end of the four heads 1 in the paper conveyance direction. The temperature sensor 61 senses temperature around the head 1 at the downstream end and outputs the sensed temperature to the controller 100, and the humidity sensor 62 senses humidity around the head 1 and outputs the sensed humidity to the controller 100.

Figure 2:
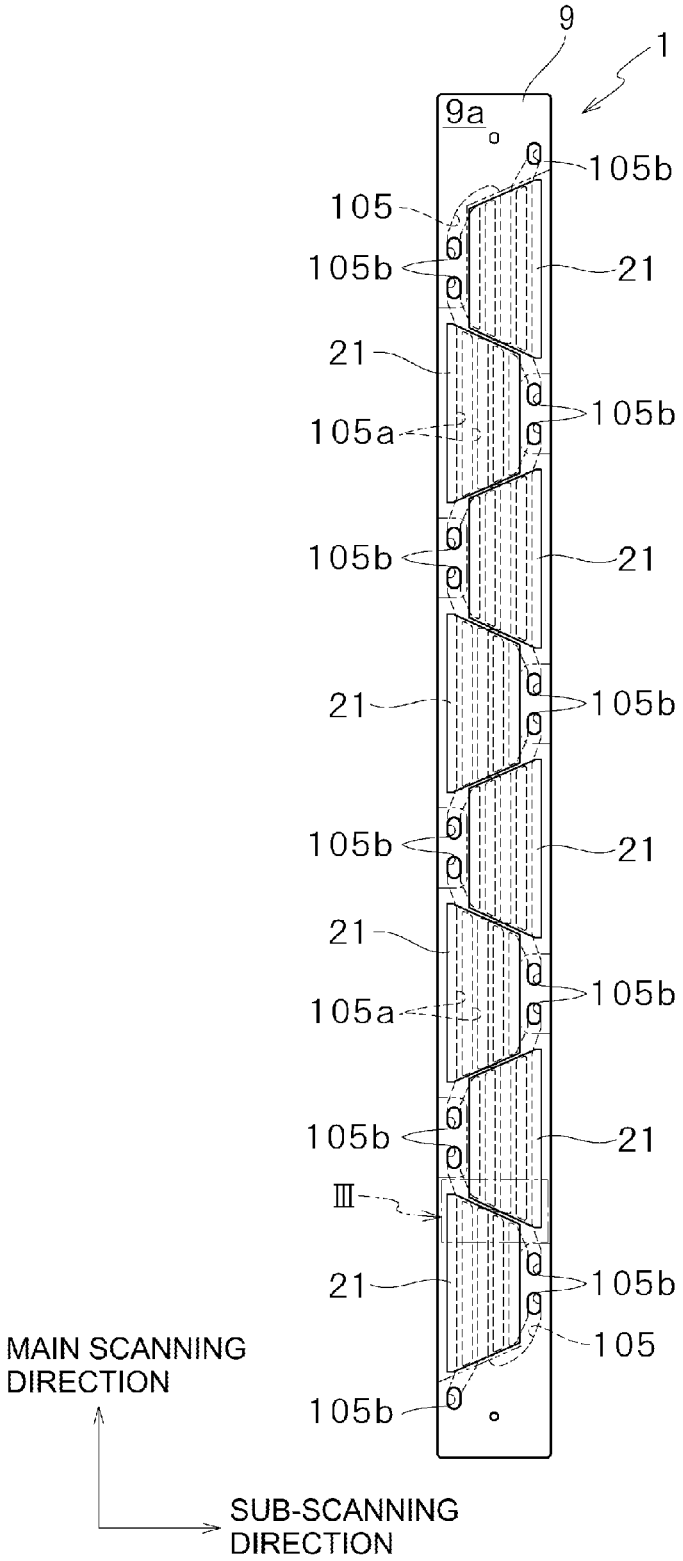
FIG. 2 is a plan view illustrating a flow path unit and actuator units in the printer head in FIG. 1.
Figure 3A:
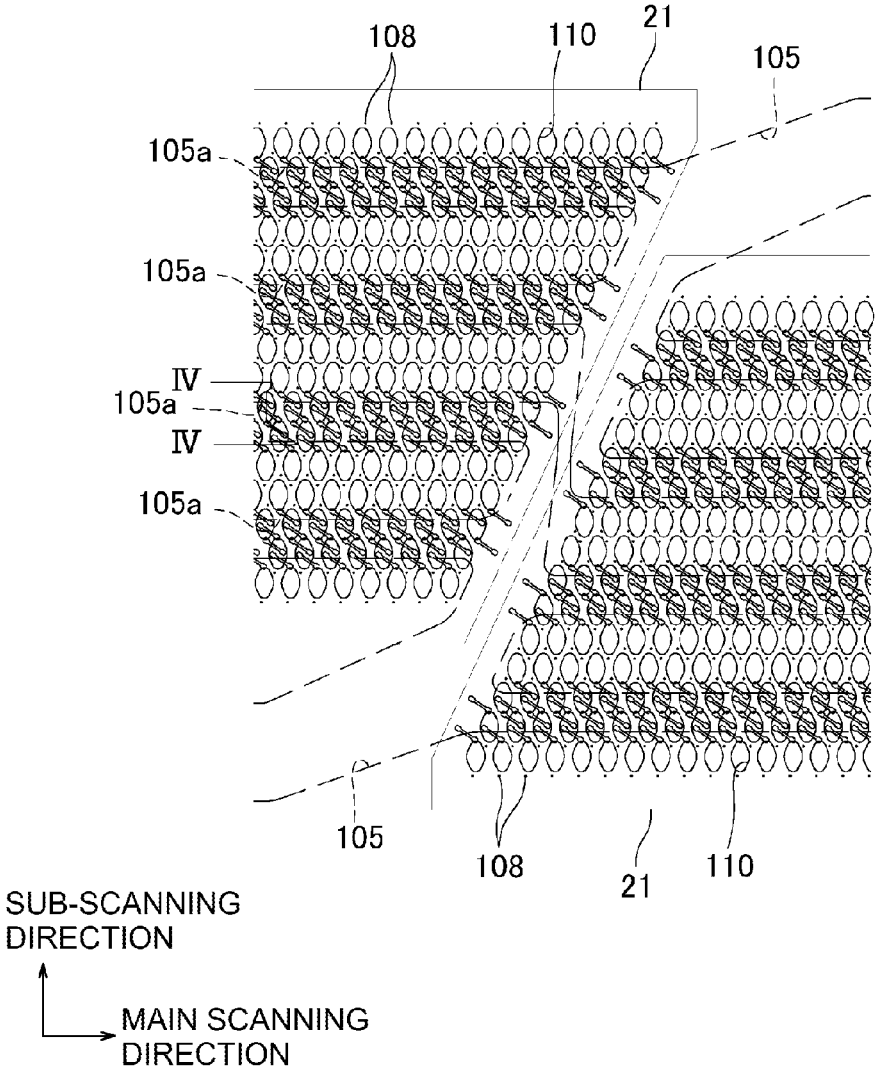
FIG. 3A is an enlarged view illustrating the area III enclosed by the dash-dot lines in FIG. 2.

Next, the head 1 will be described with reference to FIG. 2 and FIGS. 3A to 3C. In FIG. 3A, for convenience of explanation, pressure compartments 110 and the ejection openings 108, which are placed below an actuator unit 21 and should be drawn with broken lines, are drawn with solid lines.

Figure 3B:
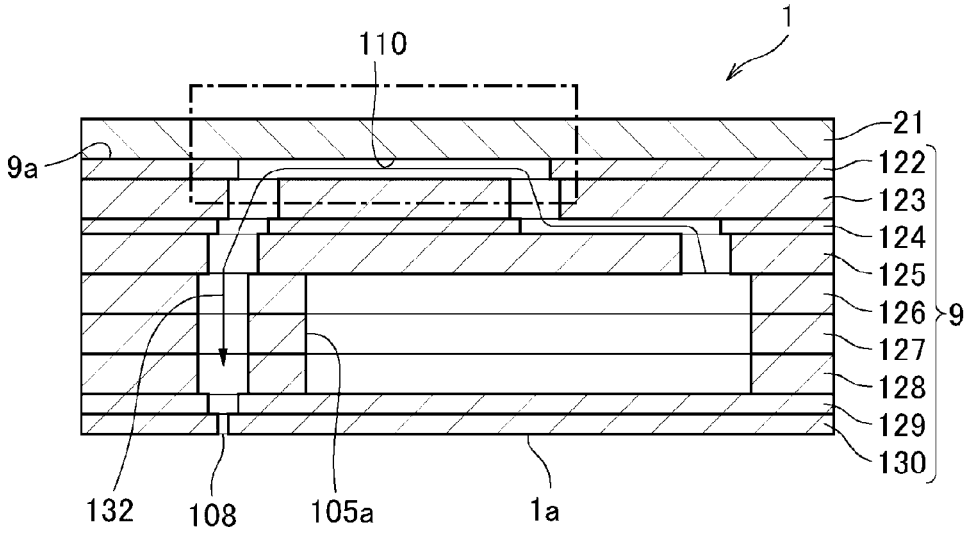
FIG. 3B is a partial cross sectional view as taken along line W-IV in FIG. 3A.

Ink supply openings 105*b*, into which ink supplied from the ink tank flows, are formed in the uppers surface 9*a* of a flow path unit 9. Manifold flow paths 105 communicating with the ink supply openings 105*b* and sub-manifold flow paths 105*a* branching from the manifold flow paths 105 are formed in the flow path unit 9 as illustrated in FIGS. 3A and 3B. Each sub-manifold flow path 105*a* is a common ink compartment. The bottom surface of the flow path unit 9 is the ejection surface 1*a* in which a plurality of ejection openings 108 are formed in a matrix. As with the ejection openings 108, a plurality of pressure compartments 110 are placed in a matrix on a securing surface of the flow path unit 9 in the actuator unit 21. In this illustrative embodiment, sixteen strings of pressure compartments 110 being arranged in the longitudinal direction of the flow path unit 9 are placed for each actuator unit 21 so that these strings are mutually parallel and equally spaced in the width direction. The ejection openings 108 are also arranged in the same way. As illustrated in FIG. 3B, the flow path unit 9 is a laminated structure in which nine stainless plates 122 to 130 are laminated. The manifold flow paths 105, the sub-manifold flow paths 105*a*, and a plurality of individual ink paths 132 are formed in the flow path unit 9. Each individual ink path 132 extends from the outlet of the sub-manifold flow path 105*a* through the pressure compartment 110 to the ejection opening 108.

Figure 3C:
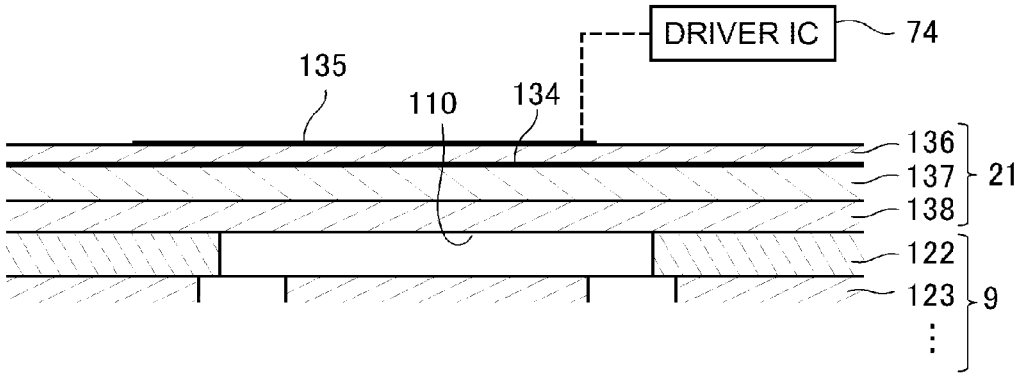
FIG. 3C is an enlarged view illustrating the area enclosed by the dash-dot lines in FIG. 3B.

Next, the actuator unit 21 will be described. As illustrated in FIG. 2, a plurality of actuator units 21 (eight actuator units 21, in this embodiment), each of which has a trapezoidal planar shape, are placed in a staggered arrangement so as to avoid contact with the ink supply openings 105*b*. As illustrated in FIG. 3C, the actuator unit 21 is formed with three piezoelectric layers 136 to 138, each of which is made of a ceramic material based on lead zirconate titanate (PZT), which is strongly dielectric. On the surface of the topmost piezoelectric layer 136, an individual electrode 135 is placed at a position facing the pressure compartment 110. A common electrode 134 is formed between the topmost piezoelectric layer 136 and a piezoelectric layer 137 provided below it so as to extend their entire surfaces.

The common electrode 134 is evenly given a ground electric potential in areas corresponding to all pressure compartments 110. A plurality of individual electrodes 135 are electrically connected to the output pins of a driver integrated circuit (IC) 74. Accordingly, the driver IC 74 can switch the electric potential of a desired individual electrode 135 or a desired plurality of individual electrodes 135. That is, in the actuator unit 21, each of a plurality of areas overlapping a plurality of individual electrodes 135 in a plan view functions as an individual actuator. That is, as many actuators as the number of pressure compartments 110 are provided in the actuator unit 21. One driver IC 74 is provided for each actuator unit 21.

In this embodiment, a predetermined positive electric potential is given to the individual electrode 135 in advance. Each time an ejection request is made, a ground electric potential is tentatively given to the individual electrode 135. After that, the driver IC 74 outputs a driving waveform (see FIGS. 4A to 4D) at a predetermined timing by which the predetermined positive electric potential is given to the individual electrode 135 again. In this case, the pressure of the ink in the pressure compartment 110 drops at a time when the individual electrode 135 falls to the ground electric potential, causing the ink to flow from the sub-manifold flow path 105*a* into the individual ink path 132. Then, the pressure of the ink in the pressure compartment 110 is raised at a time when the individual electrode 135 becomes the predetermined positive electric potential again, ejecting ink droplets from the ejection opening 108. That is, a rectangular driving waveform is given to the individual electrode 135. The voltage level of the driving waveform given from the driver IC 74 to the individual electrode 135 (that is, the difference between the ground electric potential and the predetermined positive electric potential given to the individual electrode 135) is determined according to a drive voltage V2, described later, that is supplied through the driver IC 74 to the actuator unit 21.

To enable multi-tone representation and print images with high image quality, the printer 101 in this embodiment can select a size of a liquid droplet (droplet volume) ejected from each ejection opening 108 from three sizes. That is, for one ejection opening 108, one ejection mode can be selected from a total of four ejection modes including a mode in which no droplet is ejected and three modes in which droplets with different volumes are ejected. To achieve this selection, the controller 100 inputs four types of ejection waveform data corresponding to the above four ejection modes to the driver IC 74. At the same time, the controller 100 also inputs to the driver IC 74 selection data that is used by the driver IC 74 to select one of the four ejection modes in each printing cycle. For each ejection opening 108, the driver IC 74 selects ejection waveform data corresponding to the ejection mode associated with the selection data, and amplifies the selected ejection waveform data by using the drive voltage V2 supplied to the actuator unit 21 to create a driving waveform. The driver IC 74 then outputs the created driving waveform to the actuator (individual electrode 135) corresponding to the relevant ejection opening 108.

Figures 4A, 4B, 4C, 4D:
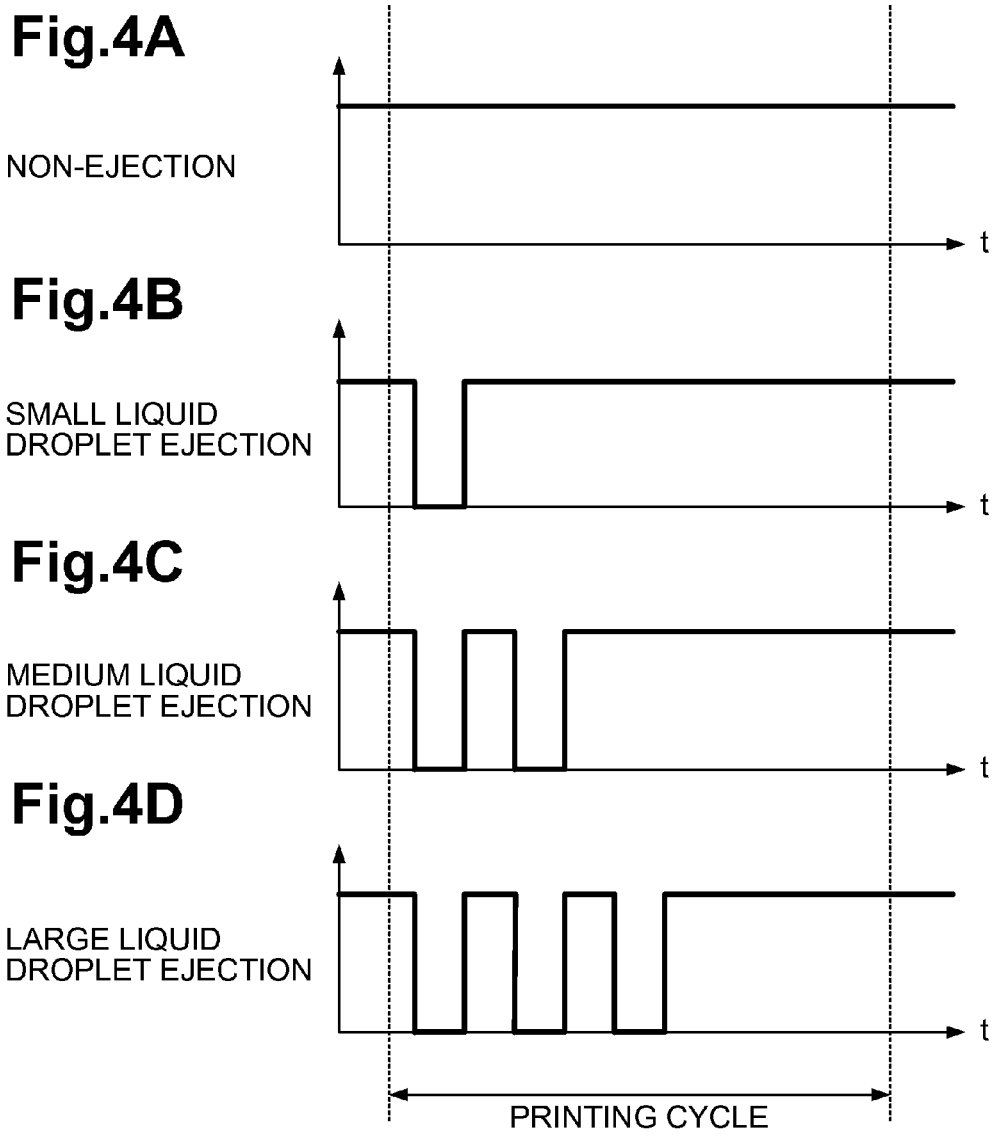
FIGS. 4A to 4D illustrate driving waveforms output to actuators in the actuator unit.

Next, driving waveforms corresponding to the four ejection modes will be described in detail. In the three ejection modes other than the mode in which liquid droplets are not ejected liquid droplets with different volumes are ejected. The driver IC 74 enables liquid droplets of different sizes to be selectively ejected from the ejection opening 108 by supplying driving waveforms with a different number of pulses to the individual electrode 135 in each printing cycle. FIGS. 4A to 4D illustrate four types of driving waveforms corresponding to the four ejection modes. Specifically, FIG. 4A illustrates a driving waveform corresponding to a non-ejection mode, FIG. 4B illustrates a driving waveform corresponding to a small liquid droplet ejection mode, FIG. 4C illustrates a driving waveform corresponding to a medium liquid droplet ejection mode, and FIG. 4D illustrates a driving waveform corresponding to a large liquid droplet ejection mode. Out of the four driving waveforms, the driver IC 74 supplies one driving waveform to the relevant actuator.

Figure 5:
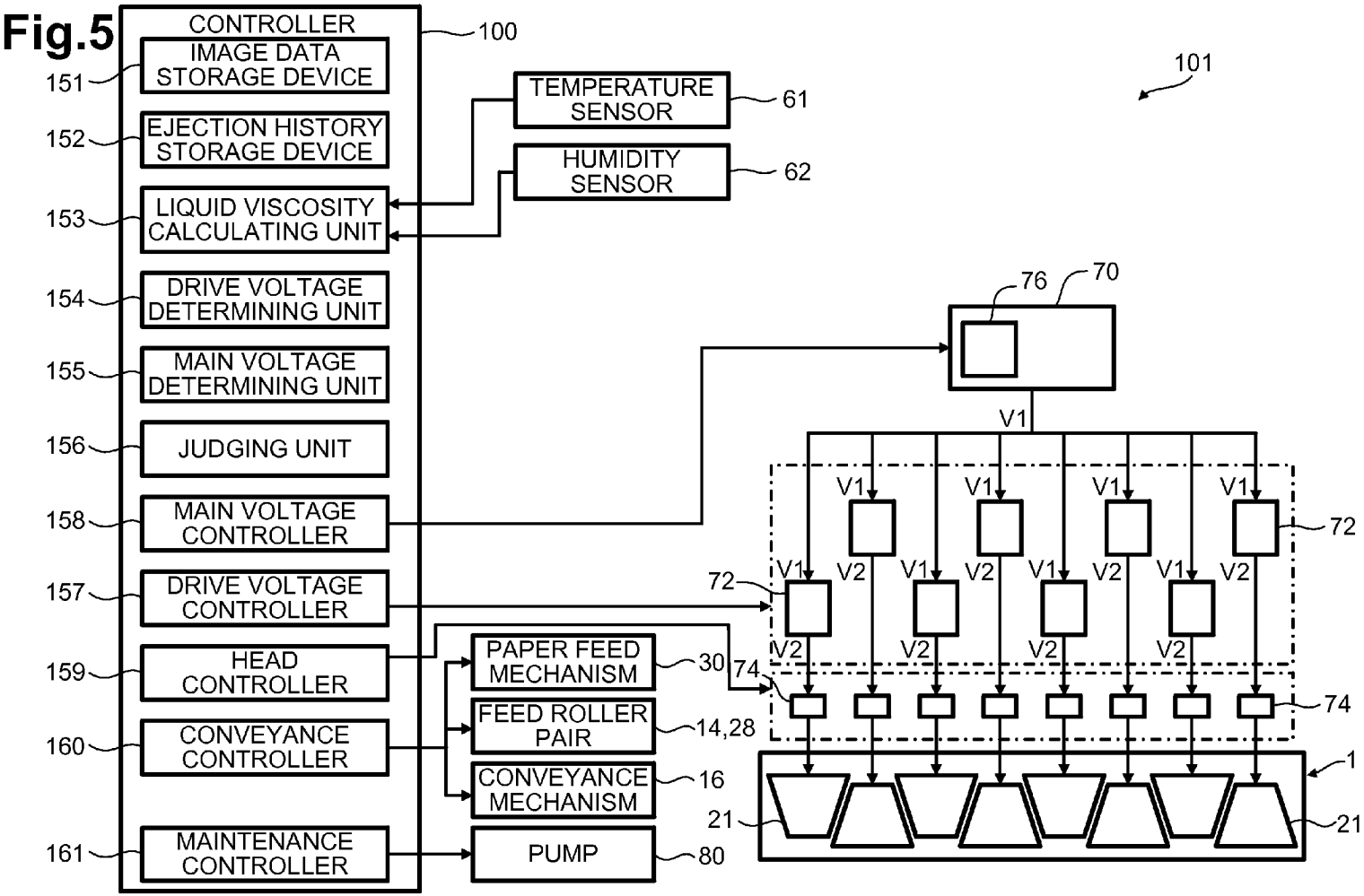
FIG. 5 is a block diagram illustrating the electrical structure of the printer in FIG. 1.

Next, the electrical structure of the printer 101 will be described with reference to FIG. 5. As illustrated in FIG. 5, the printer 101 further has a power supply unit 70 and a plurality of linear regulators 72, each of which corresponds to one actuator unit 21. A main voltage V1 output from the power supply unit 70 is decreased to the drive voltage V2 of the actuator units 21 corresponding to the plurality of linear regulators 72. The drive voltage V2 is supplied from the driver IC 74 to its corresponding actuator unit 21.

As illustrated in FIG. 5, the power supply unit 70 has a switching regulator 76 that outputs the main voltage V1, which is a predetermined voltage. The switching regulator 76 converts an input voltage to a pulse by switching it at high speed to obtain a stable DC main voltage V1. In this embodiment, a DC-DC converter is used for this conversion. There is no limitation to the method used by the DC-DC converter. For example, any of the step-down method, the step-up method, and buck-boosting method may be used. The type of the switching regulator 76 is not limited to a DC-DC converter. A switched capacitor (step-down), a charge pump (step-up), or the like may be used. As illustrated in FIG. 5, the controller 100 is connected to the power supply unit 70. The value of the main voltage V1 and the like are controlled by the controller 100.

The linear regulator 72 drops the main voltage V1 by using a resistor or the like and outputs the stable drive voltage V2. In this embodiment, a three-terminal regulator is used as the linear regulator 72. However, the type of linear regulator 72 is not limited to a three-terminal regulator. For example, a shunt regulator may be used. When the main voltage V1 is supplied to the input terminal of the linear regulator 72, the main voltage V1 is decreased to the drive voltage V2 to be used by its corresponding actuator unit 21 and the drive voltage V2 is output from the output terminal. Each linear regulator 72 is connected to the controller 100. The amount of regulation by the linear regulator 72 is controlled by the controller 100. In this embodiment, the main voltage V1 output from the power supply unit 70 is supplied to the linear regulators 72 as it is, without being decreased or increased. The drive voltage V2 output from each linear regulator 72 is supplied to its corresponding driver ICs 74 as it is, without being decreased or increased.

To enable the linear regulator 72 to stably lower the main voltage V1 down to the drive voltage V2, a voltage difference (V1−V2) between the main voltage V1 and the drive voltage V2 must be set to a value larger than or equal to a predetermined fixed voltage Vs ((V1−V2)≥Vs). In this embodiment, the predetermined fixed voltage Vs is 1.5 V. The main voltage V1 is a voltage (29.5 V, for example) that is the predetermined fixed voltage Vs (1.5 V) higher than the maximum drive voltage V2max (28 V, for example), which is maximum among the drive voltages V2 supplied from all actuator units 21. Therefore, when the maximum drive voltage V2max is lowered, the main voltage V1 can be lowered by an amount by which the V2max is lowered.

If the voltage difference (V1−V2) between the input terminal and the output terminal of the linear regulator 72 is too large, too much heat is generated by the linear regulator 72, in which case, the circuit of the linear regulator 72 may deteriorate. Since the main voltage V1 is a voltage that is the predetermined fixed voltage Vs higher than the maximum drive voltage V2max as described above, the difference between the main voltage V1 and each of the drive voltages V2 other than the maximum drive voltage V2max is larger than the maximum drive voltage V2max, increasing the amount of heat generated by the relevant linear regulator 72. Accordingly, in relation to maximum drive voltage V2max, a heat generation allowable voltage Vt (e.g. 1.5 V) has been set as the drive voltage V2 supplied to the actuator unit 21. A value obtained by subtracting the heat generation allowable voltage Vt (1.5 V) from the maximum drive voltage V2max (28 V) becomes the allowable minimum voltage (26.5 V) of the drive voltage V2. In other words, the allowable minimum voltage (26.5 V) is a value obtained by subtracting a total value (3.0 V) of the fixed voltage Vs (1.5 V) and the heat generation allowable voltage Vt (1.5 V) from the main voltage V1 (29.5V), the total value being referred to below as the allowable value. The drive voltage V2 supplied to each actuator unit 21 must be set between the maximum drive voltage V2max and the minimum allowable voltage. The heat generation allowable voltage Vt is set on the basis of the fact that as the maximum drive voltage V2max is increased, a high current flows in the linear regulator 72 and the amount of heat generated is thereby increased. In this embodiment, the allowable value is equivalent to the first value.

Next, the controller 100 will be described in detail. The controller 100 includes a central processing unit (CPU), a read-only memory (ROM) that permanently stores control programs executed by the CPU and data used by the control programs, random-access memory (RAM) that temporarily stores data during control program execution. These hardware components and software in the ROM cooperate to create functional units constituting the controller 100. As the functional units, the controller 100 includes an image data storage device 151, an ejection history storage device 152, a liquid viscosity calculating unit 153, a drive voltage determining unit 154, a main voltage determining unit 155, a judging unit 156, a drive voltage controller 157, a main voltage controller 158, a head controller 159, a conveyance controller 160, and a maintenance controller 161, illustrated in FIG. 5.

The image data storage device 151 stores image data supplied from an external apparatus such as a personal computer (PC) connected to the printer 101. The image data is data used to form an image on the paper P. The ejection history storage device 152 stores an ejection history of ink ejected from each ejection opening 108 in the head 1.

The liquid viscosity calculating unit 153 calculates the viscosity of the ink in the ejection opening 108 corresponding to each actuator included in each actuator unit 21. Specifically, the liquid viscosity calculating unit 153 calculates the viscosity of the ink in each ejection opening 108 according to the ejection history of the ink ejected from the ejection opening 108, the ejection history being stored in the ejection history storage device 152, and output results obtained from the temperature sensor 61 and humidity sensor 62. The liquid viscosity calculating unit 153 then selects the maximum viscosity from the viscosities of the inks in the ejection openings 108 corresponding to the actuators included in the actuator unit 21 as the viscosity involved in the actuator unit 21.

The drive voltage determining unit 154 determines an ideal drive voltage V2 that should be supplied to one of the plurality of actuator units 21 according to the ink viscosity calculated by the liquid viscosity calculating unit 153 for each actuator unit 21. The higher the viscosity of the ink in the ejection opening 108 is, the more difficult the ink is ejected from the ejection opening 108. To eject the same amount of ink from the ejection opening 108, therefore, the voltage level of the driving waveform used to drive the ejection opening 108 must be increased. That is, the drive voltage V2 to be supplied to the actuator unit 21 must be increased. In this embodiment, a drive voltage table, which indicates a relationship between the viscosity of the ink in each ejection opening 108 and the drive voltage V2, is prestored in the controller 100. The drive voltage determining unit 154 references the drive voltage table and determines an ideal drive voltage V2 to be supplied to one of the plurality of actuator units 21.

The main voltage determining unit 155 determines an ideal main voltage V1 to be output, according to the maximum determined drive voltage, which is the highest drive voltage among the ideal drive voltages V2 determined by the drive voltage determining unit 154. Specifically, the main voltage determining unit 155 adds the fixed voltage Vs to the maximum determined drive voltage and determines the resulting voltage as the ideal main voltage V1.

The judging unit 156 decides for each of the actuator units 21 whether a voltage difference between the ideal drive voltage V2 determined by the drive voltage determining unit 154 and the ideal main voltage V1 determined by the main voltage determining unit 155 is greater than an allowable value (3.0 V, which is a sum of the fixed voltage Vs and the heat generation allowable voltage Vt). If the judging unit 156 decides that there is a voltage difference larger than the allowable value, the judging unit 156 decides for each of the actuator units 21 whether a voltage difference between the ideal main voltage V1 and the ideal drive voltage V2 is greater than a maintenance value (described later).

The drive voltage controller 157 controls each linear regulator 72 so that the ideal drive voltage V2 determined by the drive voltage determining unit 154 is supplied to the corresponding actuator unit 21. If the judging unit 156 decides that a voltage difference between the ideal drive voltage V2 and the ideal main voltage V1 determined by the main voltage determining unit 155 is greater than the allowable value for any of the actuator units 21, the drive voltage controller 157 performs drive voltage adjustment processing, in which the drive voltage V2 to be supplied to at least one actuator unit 21 is adjusted, so that the voltage difference falls to or below the allowable value.

The main voltage controller 158 controls the switching regulator 76 so that the ideal main voltage V1 determined by the main voltage determining unit 155 is output from the power supply unit 70. When drive voltage adjustment processing is performed by the drive voltage controller 157, the main voltage controller 158 performs main voltage adjustment processing, in which the main voltage V1 is adjusted, accordingly. Specifically, if the maximum drive voltage V2max becomes lower than the maximum determined drive voltage among the ideal drive voltages V2 determined by the drive voltage determining unit 154 as a result that the drive voltage controller 157 has adjusted the drive voltage V2 to be supplied to the relevant actuator unit 21, the main voltage controller 158 controls the switching regulator 76 so that a voltage obtained by adding the fixed voltage Vs to the maximum drive voltage V2max matches the main voltage V1.

Figure 6A:
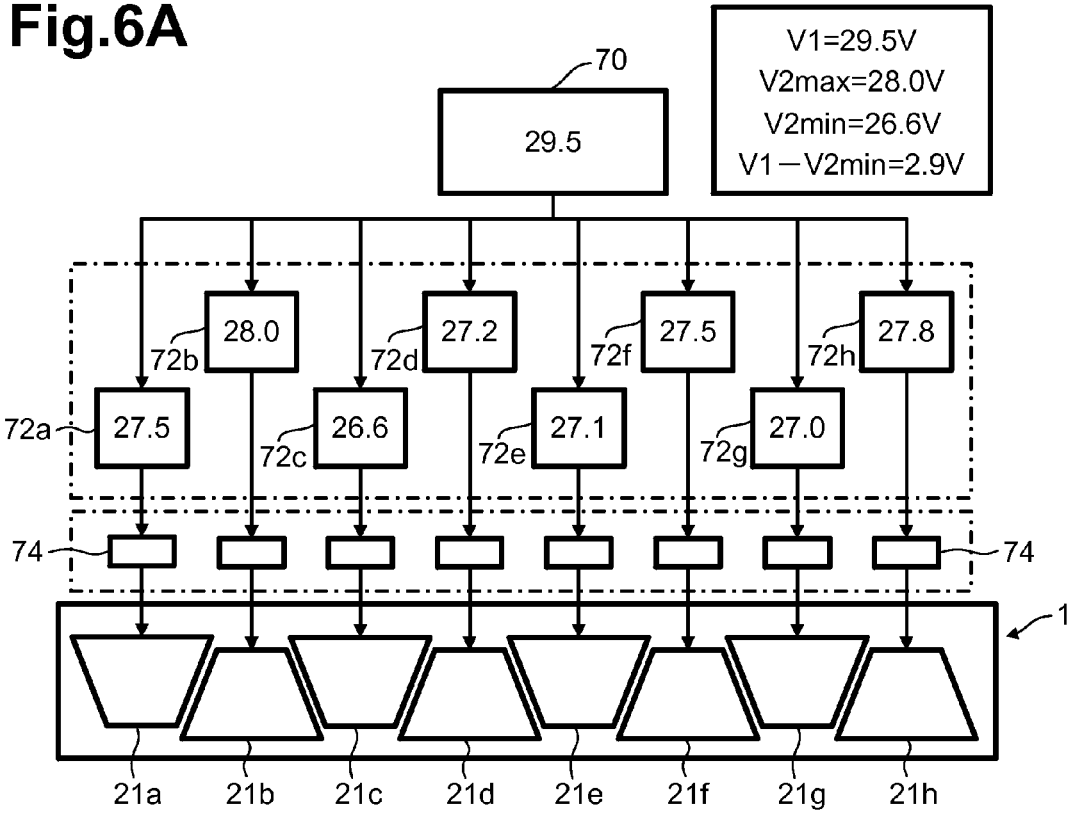
FIGS. 6A and 6B illustrate drive voltage adjustment processing and main voltage adjustment processing.
Figure 6B:
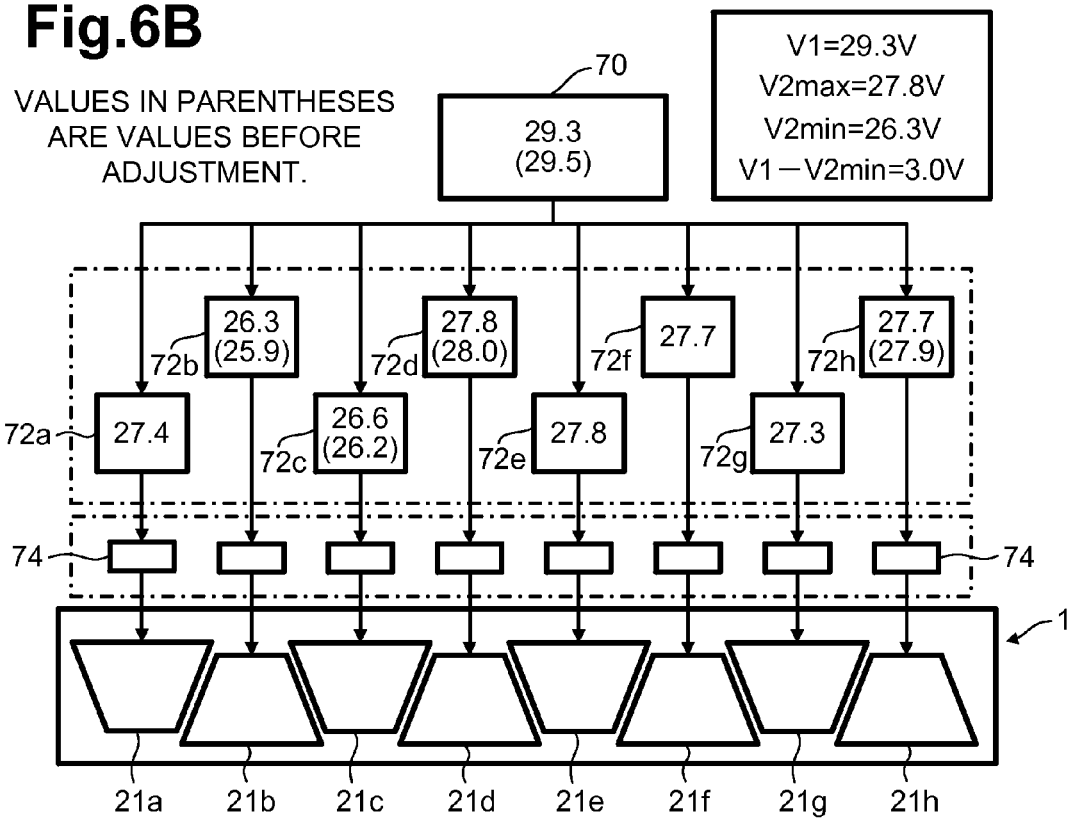

Next, drive voltage adjustment processing performed by the drive voltage controller 157 and main voltage adjustment processing performed by the main voltage controller 158 will be described with reference to FIGS. 6A and 6B. In FIGS. 6A and 6B, eight actuator units 21 are denoted 21*a* to 21*h*, and eight linear regulators 72 are denoted 72*a* to 72*h*. In the box of the power supply unit 70, the value of the main voltage V1 is written. In the boxes of the linear regulators 72*a* to 72*h*, the values of the drive voltages V2 are written.

If the drive voltages V2 determined by the drive voltage determining unit 154 and the ideal main voltage V1 determined by the main voltage determining unit 155 are as indicated in FIG. 6A, a voltage difference between the main voltage V1 (29.5 V) and the minimum determined drive voltage (26.6V), which is lowest among the drive voltages V2, is not larger than the allowable value (3.0 V). Therefore neither drive voltage adjustment processing nor main voltage adjustment processing needs to be performed. In this case, it suffices that the drive voltage controller 157 controls each of the linear regulators 72 so that the ideal drive voltage V2 determined by the drive voltage determining unit 154 is supplied to each of the actuator units 21 and that the main voltage controller 158 controls the switching regulator 76 so that the ideal main voltage V1 determined by the main voltage determining unit 155 is output from the power supply unit 70.

If, however, the drive voltages V2 determined by the drive voltage determining unit 154 and the ideal main voltage V1 determined by the main voltage determining unit 155 are as indicated in FIG. 6B, a voltage difference between the main voltage V1 (29.5 V) and the drive voltage V2 (25.9 V) involved in the actuator unit 21*b* and a voltage difference between the main voltage V1 and the drive voltage V2 (26.2 V) involved in the actuator unit 21*c* are larger than the allowable value (3.0 V). As such, both voltage adjustment processing and main voltage adjustment processing need to be performed to prevent the relevant linear regulators 72 from being deteriorated due to heat.

Accordingly, the drive voltage controller 157 first makes an adjustment so that the difference between the maximum determined drive voltage and the minimum determined drive voltage among the ideal drive voltages V2 determined by the drive voltage determining unit 154 falls to or below the heat generation allowable voltage Vt (1.5 V). In the example in FIG. 6B, the drive voltage V2 involved in the actuator unit 21*d* is the maximum determined drive voltage (28.0 V) and the drive voltage V2 involved in the actuator unit 21*b* is the minimum determined drive voltage (25.9 V), a voltage difference therebetween being 2.1 V. The drive voltage controller 157 controls the linear regulators 72*b* and 72*d* so that the drive voltage V2 involved in the actuator unit 21*b* becomes a high drive voltage that is higher than the minimum determined drive voltage (25.9 V) and the drive voltage V2 involved in the actuator unit 21*d* becomes a low drive voltage that is lower than the maximum determined drive voltage (28.0 V). Specifically, the drive voltage controller 157 controls the linear regulators 72*b* and 72*d* so that a value obtained by the addition of the difference between the high drive voltage and the minimum determined drive voltage involved in the actuator unit 21*b* (the difference will be referred to below as the amount of low drive voltage adjustment) and the difference between the low drive voltage and the maximum determined drive voltage involved in the actuator unit 21*d* (the difference will be referred to below as the amount of high drive voltage adjustment) is not smaller than a value (0.6 V, the value will be referred to below as the ideal voltage difference) obtained by subtracting the heat generation allowable voltage Vt (1.5 V) from the voltage difference (2.1 V) between the maximum determined drive voltage and the minimum determined drive voltage and is smaller than the voltage difference (2.1 V) between the maximum determined drive voltage and the minimum determined drive voltage. In the example in FIG. 6B, the amount of low drive voltage adjustment is set to 0.4 V and the amount of high drive voltage adjustment is set to 0.2 V so that a value obtained by the addition of the amount of low drive voltage adjustment and the amount of high drive voltage adjustment matches the ideal voltage difference (0.6 V). Therefore, the drive voltage V2 involved in the actuator unit 21*b* is set to 26.3 V and the drive voltage V2 involved in the actuator unit 21*d* is set to 27.8 V.

After that, taking the drive voltage V2 involved in the actuator unit 21*b* (26.3 V) as the minimum drive voltage V2 min and also taking the drive voltage V2 involved in the actuator unit 21*d* (27.8 V) as the maximum drive voltage V2max, the drive voltage controller 157 controls the linear regulators 72 so that all other drive voltages V2 involved in the other actuator units 21 fall between the minimum drive voltage V2 min and the maximum drive voltage V2man. In the example in FIG. 6B, the drive voltage controller 157 controls the linear regulators 72 so that the drive voltage V2 involved in the actuator unit 21*c* becomes a high drive voltage (26.6 V) that is higher than its ideal drive voltage V2 (26.2 V), the drive voltage V2 involved in the actuator unit 21*h* becomes a low drive voltage (27.7 V) that is lower than its ideal drive voltage V2 (27.9 V), and the drive voltages V2 involved in the other actuator units 72*a*, 72*e*, 72*f*, and 72*g* match the ideal drive voltage V2 determined by the drive voltage determining unit 154.

The amount of voltage adjustment by which the drive voltage V2 is adjusted from the ideal drive voltage V2 determined by the drive voltage determining unit 154 to a high drive voltage is set so that when the driving waveform output from the driver IC 74 to the actuators, included in the actuator unit 21 for which the voltage to be supplied to it is adjusted to a high drive voltage, is changed to a small ejection driving waveform (described later), the amount of ink to be ejected from the ejection opening 108 corresponding to the actuator becomes substantially the same as the amount of ink to be ejected when the ideal drive voltage V2 determined by the drive voltage determining unit 154 is being supplied to the actuator unit 21 and the driving waveform created according to image data stored in the image data storage device 151 has been supplied to the actuator (the amount of ink to be ejected at this time will be referred to below as the ideal ejection amount). This is also true when the driving waveform output from the driver IC 74 to the actuators, included in the actuator unit 21 for which the voltage to be supplied to it is adjusted to a low drive voltage, is changed to a large ejection driving waveform (described later). That is, even if the ideal drive voltage V2 is not supplied, when the amount of voltage adjustment equivalent to a change between driving waveforms is set, the amount of ink actually ejected can be made substantially the same as the ideal amount of ink to be ejected.

In main voltage adjustment processing, since the maximum drive voltage is lowered from 28.0 V to 27.8 V by the drive voltage controller 157 in drive voltage adjustment processing described above, the main voltage controller 158 controls the switching regulator 76 so that the main voltage V1 to be output from the power supply unit 70 becomes lower than the ideal main voltage V1 determined by the main voltage determining unit 155. Specifically, the main voltage controller 158 controls the switching regulator 76 so that the voltage (29.3 V) obtained by the addition of the maximum drive voltage (27.8 V) obtained after drive voltage adjustment processing and the predetermined fixed voltage Vs (1.5 V) matches the main voltage V1.

As described above, the voltage difference between the main voltage V1 and the drive voltage V2 involved in each of the linear regulators 72 can be made lower than or equal to the allowable value (3.0 V) in drive voltage adjustment processing by the drive voltage controller 157 and main voltage adjustment processing by the main voltage controller 158, so it is possible to prevent the linear regulator 72 from being deteriorated due to heat.

The head controller 159 controls a plurality of driver ICs 74 in each head 1 according to image data stored in the image data storage device 151. Specifically, the head controller 159 sends the four types of ejection waveform data, described above, to the driver ICs 74. The head controller 159 also sends selection data, which is used to have the driver IC 74 select one from the above four types of ejection waveform data (the selection data will be referred to below the basic selection data), in each printing cycle according to image data stored in the image data storage device 151. Accordingly, the driver IC 74 selects, for each individual electrode 135, ejection waveform data from the four types of ejection waveform data corresponding to the four ejection modes. The driver IC 74 amplifies the selected ejection waveform data by using the drive voltage V2 supplied to the actuator unit 21 and outputs the amplified driving waveform to the relevant individual electrode 135 in the actuator unit 21. As a result, ink is selectively ejected from the ejection openings 108 corresponding to the individual electrodes 135 (actuators) in each printing cycle of the head 1.

In the above drive voltage adjustment processing by the drive voltage controller 157, the drive voltage V2 to be supplied to the actuator unit 21 may be adjusted to a high drive voltage higher than the ideal drive voltage V2 determined by the drive voltage determining unit 154. In this case, the voltage level of the driving waveform output from the driver IC 74 becomes large, so the amount of ink to be ejected from the ejection opening 108 becomes larger than the ideal amount of ink to be ejected. As a result, the image quality of an image formed on paper P may deteriorate.

In this embodiment, therefore, the driving waveform output from driver ICs 74 to their corresponding actuators included in the actuator units 21*b* and 21*c*, for which the drive voltage V2 is adjusted to a high drive voltage, is set to a driving waveform corresponding to a smaller amount of ink to be ejected than the amount of ink to be ejected in correspondence to the driving waveform created according to image data stored in the image data storage device 151 (the waveform corresponding to the smaller amount of ink to be ejected will be referred to below as the small ejection driving waveform). For example, when the driving waveform output according to image data stored in the image data storage device 151 is a driving waveform corresponding to the medium liquid droplet ejection mode, a driving waveform corresponding to the small liquid droplet ejection mode is output; when the driving waveform output according to image data stored in the image data storage device 151 is a driving waveform corresponding to the large liquid droplet ejection mode, a driving waveform corresponding to the small or medium liquid droplet ejection mode is output. When the driving waveform output according to image data stored in the image data storage device 151 is a driving waveform corresponding to the small liquid droplet ejection mode, the driving waveform corresponding to the small liquid droplet ejection mode is output without alternation.

Specifically, the head controller 159 sends to the driver ICs 74 corresponding to the actuator units 21*b* and 21*c*, for which the drive voltage V2 is adjusted to a high drive voltage in the above drive voltage adjustment processing by the drive voltage controller 157, selection data by which the driver IC 74 selects ejection waveform data according to which a smaller amount of ink is ejected (droplets with a smaller volume are ejected) when compared with the ejection waveform data selected by the driver IC 74 according to image data stored in the image data storage device 151 (the selection data will be referred to below as the small ejection selection data). Thus, the driver IC 74 creates a small ejection driving waveform corresponding to a smaller amount of ink to be ejected than the amount of ink to be ejected in correspondence to the driving waveform created according to image data stored in the image data storage device 151. Then, the driver IC 74 supplies the created small ejection driving waveform to the relevant actuator in the actuator unit 21 for which the drive voltage V2 has been adjusted to a high drive voltage. As a result, the amount of ink to be ejected from the ejection opening 108 can be made substantially the same as the ideal amount of ink to be ejected, so it is possible to suppress deterioration of the image quality of an image formed on the paper P. In this embodiment, the driver IC 74 and head controller 159 are respectively equivalent to a driving waveform creating unit and a driving waveform output unit.

In image formation, the conveyance controller 160 controls the operations of the paper feed mechanism 30, feed roller pairs 14 and 28, and conveyance mechanism 16 so that the paper P is conveyed at a predetermined conveyance speed in the conveyance direction.

The maintenance controller 161 performs a maintenance operation for the head 1. If there is a large voltage difference between the ideal main voltage V1 and the ideal drive voltage V2 for any of the actuator units 21, the amount of drive voltage V2 adjustment in the above drive voltage adjustment processing by the drive voltage controller 157 is also significantly increased. Therefore, even if the small ejection driving waveform is output to the relevant actuator included in the actuator unit 21 for which the drive voltage V2 is adjusted to a high drive voltage, the effect that deterioration of the image quality of an image formed on the paper P is suppressed is small. In view of this, in this embodiment if the judging unit 156 decides that a voltage difference between the ideal main voltage V1 and the ideal drive voltage V2 is greater than a maintenance value (second predetermined value) for any of the actuator units 21, the maintenance controller 161 performs a maintenance operation for the head 1.

In this embodiment, the maintenance controller 161 controls the pump 80 as the maintenance operation to perform a purge operation by which ink is forcibly ejected from the ejection openings 108. This causes viscous ink from being discharged from the ejection openings 108. As a result, the viscosity of the ink in each ejection opening 108 can be made substantially the same, so differences in the ideal drive voltage V2 among the actuator units 21 can be reduced. Therefore, a difference between the main voltage V1 and the drive voltage V2 in each actuator unit 21 can be made smaller than the allowable value. In this embodiment, the pump 80 is equivalent to a maintenance mechanism.

Figure 7:
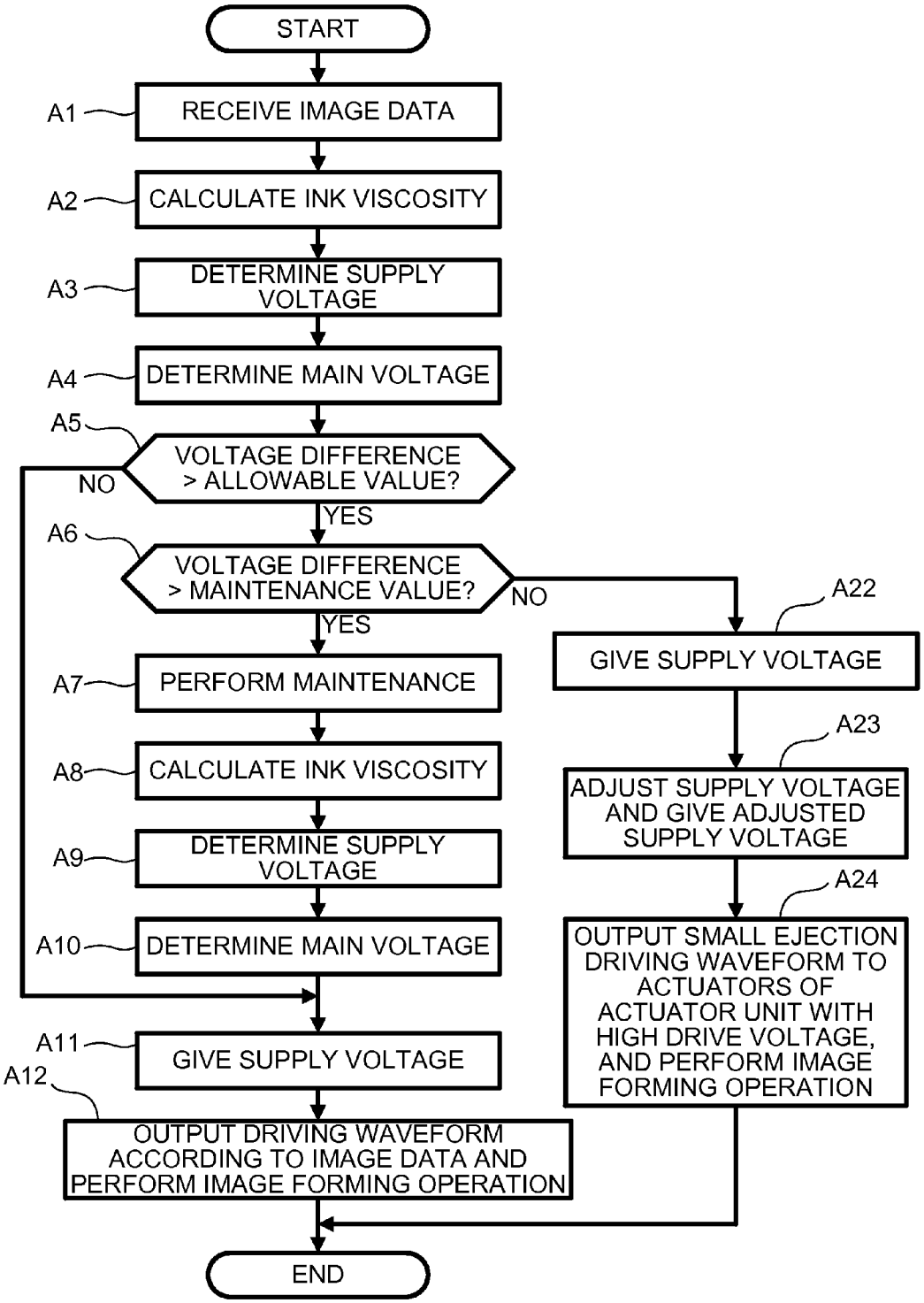
FIG. 7 illustrates an operation flow of the printer in FIG. 1.

Next, an example of the operation of the printer 101 will be described with reference to FIG. 7. First, when the controller 100 receives image data from an external apparatus (A1), the liquid viscosity calculating unit 153 calculates the viscosity of the ink in the ejection openings 108 corresponding to the actuators including in each actuator unit 21 (A2). Then, the drive voltage determining unit 154 determines the drive voltage V2 to be supplied to each actuator unit 21 according to the viscosity of the ink for the actuator unit 21, which has been calculated by the liquid viscosity calculating unit 153 (A3). After that, the main voltage determining unit 155 determines the ideal main voltage V1 to be output, according to the maximum determined drive voltage, which is the highest drive voltage among the ideal drive voltages V2 determined by the drive voltage determining unit 154 (A4).

Next, the judging unit 156 decides for each of the actuator units 21 whether a voltage difference between the ideal drive voltage V2 determined by the drive voltage determining unit 154 and the ideal main voltage V1 determined by the main voltage determining unit 155 is greater than the allowable value (A5). If the judging unit 156 decides that no voltage difference between the ideal main voltage V1 and the ideal drive voltage V2 is greater than the allowable value for any of the actuator units 21 (the result in step A5 is No), the judging unit 156 determines that neither drive voltage adjustment processing nor main voltage adjustment processing needs to be performed, causing the sequence to proceed step A11.

If the judging unit 156 decides that there is a voltage difference between the main voltage V1 and the ideal drive voltage V2, is greater than the allowable value for any of the actuator units 21 (the result in step A5 is Yes), the judging unit 156 decides for each of the actuator units 21 whether there is a voltage difference, between the ideal drive voltage V2 determined by the drive voltage determining unit 154 and the ideal main voltage V1 determined by the main voltage determining unit 155, is greater than the maintenance value (A6).

If the judging unit 156 decides that a voltage difference between the main voltage V1 and the ideal drive voltage V2 is greater than the maintenance value for any of the actuator units 21 (the result in step A6 is Yes), the maintenance controller 161 controls the pump 80 as the maintenance operation to perform a purge operation by which ink is forcibly ejected from the ejection openings 108 (A7). Thus, the viscosity of the ink in each ejection opening 108 can be made substantially the same. Upon completion of the processing in step A7, processing in steps A8 to A10, which is substantially the same as the processing in steps A2 to A4, is executed. The sequence then proceeds to step A11.

In step A11, the main voltage controller 158 controls the switching regulator 76 so that the ideal main voltage V1 determined by the main voltage determining unit 155 is output from the power supply unit 70, and the drive voltage controller 157 controls each of the linear regulators 72 so that the ideal drive voltage V2 determined by the drive voltage determining unit 154 is supplied to the relevant actuator unit 21.

Upon completion of the processing in step A11, the head controller 159 and conveyance controller 160 perform an image forming operation (A12). Specifically, the conveyance controller 160 controls the operations of the paper feed mechanism 30, feed roller pairs 14 and 28, and conveyance mechanism 16 so that the paper P is conveyed at a predetermined conveyance speed in the conveyance direction. The head controller 159 sends the four types of ejection waveform data and the basic selection data to each of the driver ICs 74. Thus, ink is selectively ejected from the ejection openings 108 in correspondence to the individual electrodes 135 in each printing cycle, forming an image on the paper P. Upon completion of the processing in step A12, the processing by the printer 101 is terminated.

If the judging unit 156 decides in step A6 that no voltage difference, between the main voltage V1 and an ideal drive voltage V2 is greater than the maintenance value for any of the actuator units 21 (the result in step A6 is No), the main voltage controller 158 controls the switching regulator 76 so that the main voltage V1 determined by the main voltage determining unit 155 is output from the power supply unit 70 (A22), and the drive voltage controller 157 performs drive voltage adjustment processing and the main voltage controller 158 performs main voltage adjustment processing (A23). Thus, a drive voltage V2, the difference of which from the main voltage V1 does not exceed the allowable value, is supplied to each of the linear regulators 72.

Next, the head controller 159 and conveyance controller 160 perform an image forming operation (A24). Specifically, the conveyance controller 160 controls the operations of the paper feed mechanism 30, feed roller pairs 14 and 28, and conveyance mechanism 16 so that the paper P is conveyed at a predetermined conveyance speed in the conveyance direction. The head controller 159 sends the four types of ejection waveform data to each of the driver ICs 74. The head controller 159 also sends basic selection data to each of the driver ICs 74 corresponding to actuator units 21 other than the actuator units 21 for which the drive voltage V2 has been adjusted to a high drive voltage. The head controller 159 sends small ejection selection data to the driver ICs 74 corresponding to the actuator units 21 for which the drive voltage V2 has been adjusted to a high drive voltage. Thus, in the driver ICs 74 corresponding to the actuator units 21 other than the actuator units 21 for which the drive voltage V2 has been adjusted to a high drive voltage, driving waveforms are created according to image data stored in the image data storage device 151. In the driver IC 74 corresponding to each actuator unit 21 for which the drive voltage V2 has been adjusted to a high drive voltage, a small ejection driving waveform is created. As a result, it is possible to suppress deterioration of the image quality of an image formed on the paper P. Upon completion of the processing in step A24, the processing by the printer 101 is terminated.

With the printer 101 in this embodiment, if a voltage difference between an ideal drive voltage V2 determined by the drive voltage determining unit 154 and the ideal main voltage V1 determined by the main voltage determining unit 155 is greater than the allowable value for any of the actuator units 21, the voltage difference between the main voltage V1 and the drive voltage V2 is made smaller than or equal to the allowable value for all actuator units 21. Therefore, it is possible to suppress heat generation by the linear regulators 72. Although ink is easily ejected from the ejection openings 108 corresponding to the actuators included in the actuator unit 21 for which the drive voltage V2 is adjusted to a high drive voltage, a small ejection driving waveform is created for each of the actuators as the driving waveform that drives the actuator, the small ejection driving waveform being used to eject a smaller amount of ink than the amount of ink ejected according to the driving waveform created from the image data. Thus, it is possible to suppress deterioration of the image quality of an image formed on the paper P.

Unlike this embodiment, there may be a case in which the main voltage V1 cannot be adjusted. Such a case will now be considered. In this case, the value of the main voltage V1 remains unchanged. To make a voltage difference between the main voltage V1 and an ideal drive voltage V2 smaller than or equal to the allowable value for each of the actuator units 21, at least the drive voltage V2 to be supplied to the actuator unit 21 involved in the minimum determined drive voltage must be raised so that the difference between the main voltage V1 and the drive voltage V2 falls to or below the allowable value. Specifically, in the example in FIG. 6B, the drive voltage V2 involved in the actuator unit 21*b* must be raised from the minimum determined drive voltage (25.9 V) to 26.5 V, the amount of adjustment being 0.6 V. Even if a small ejection driving waveform is output to the actuators in the actuator unit 21*b*, the effect that deterioration of the image quality of an image formed on the paper P is suppressed may become small. In this embodiment however, if a voltage difference between the ideal drive voltage V2 determined by the drive voltage determining unit 154 and the ideal main voltage V1 determined by the main voltage determining unit 155 is greater than the allowable value for any of the actuator units 21, the main voltage V1 is also reduced. As a result, an amount by which a drive voltage V2 to be supplied to each actuator unit 21 is adjusted by the drive voltage controller 157 can be reduced. Thus, it is possible to suppress deterioration of the image quality of an image formed on the paper P due to a large amount of drive voltage V2 adjustment.

In this embodiment, if a voltage difference between the ideal drive voltage V2 determined by the drive voltage determining unit 154 for each of the actuator units 21 and the ideal main voltage V1 determined by the main voltage determining unit 155 is greater than the maintenance value for any of the actuator units 21, the maintenance of the head 1 is carried out. As a result, the voltage difference between the main voltage V1 and the drive voltage V2 involved in each of the actuator units can be made lower than or equal to the allowable value. Thus, it is possible to suppress deterioration of the image quality of an image formed on the paper P.

Figure 8:
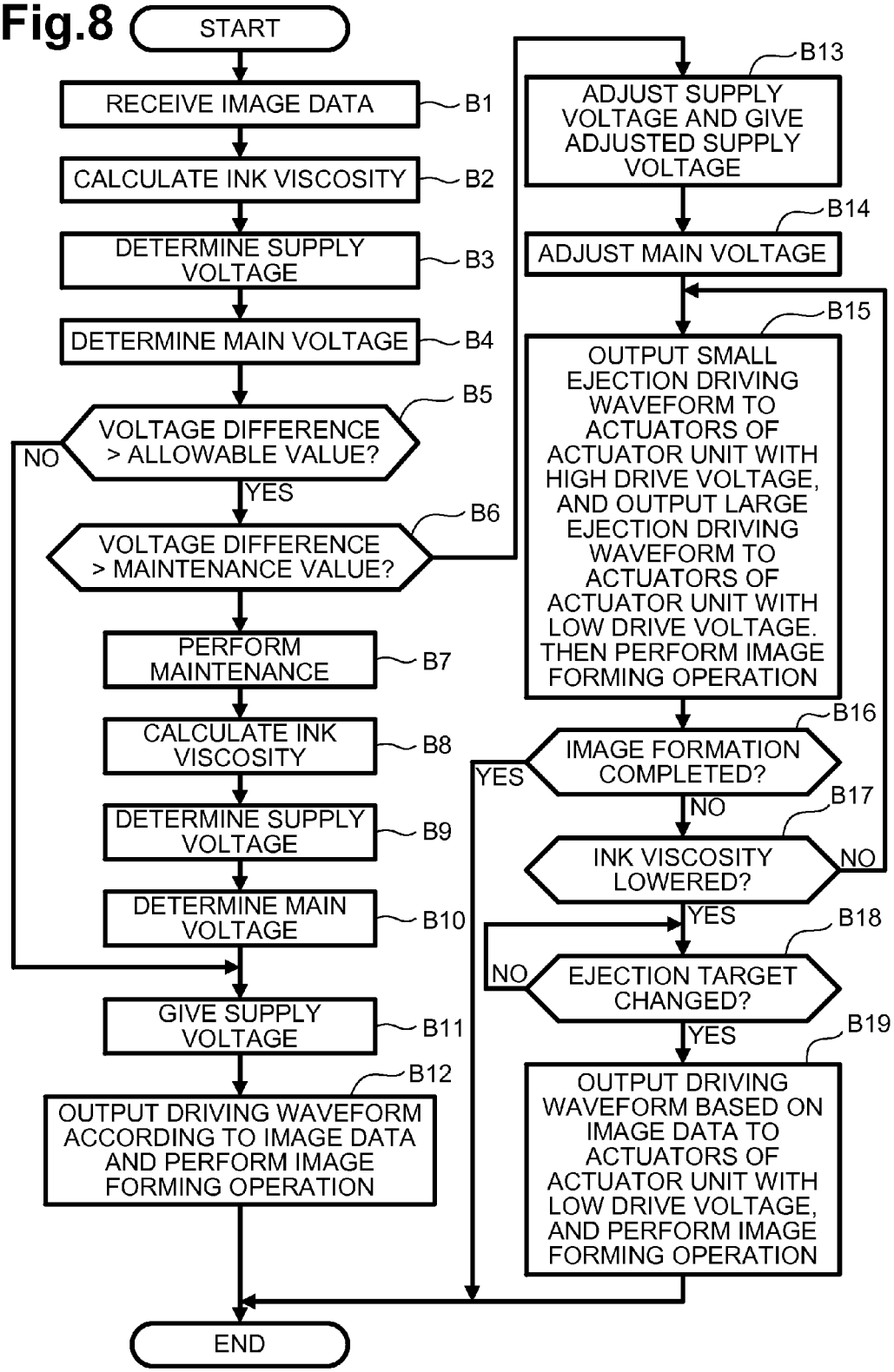
FIG. 8 illustrates an operation flow of an inkjet printer in another example embodiment according to one or more aspects of the disclosure.

Another embodiment will be described with reference to FIG. 8. This embodiment differs from the above embodiment in that in this embodiment driver IC 74 adjusts the driving waveform it outputs to the actuators included in an actuator unit 21 for which the drive voltage V2 is adjusted to a low drive voltage lower than the ideal drive voltage V2 determined by the drive voltage determining unit 154. The drive voltage V2 is set to a driving waveform corresponding to a larger amount of ink to be ejected than the amount of ink to be ejected in correspondence to the driving waveform created according to image data stored in the image data storage device 151 (the waveform corresponding to the larger amount of ink to be ejected will be referred to below as the large ejection driving waveform). In the descriptions below, the same elements in the embodiment described above are denoted by the same reference characters, and repeated descriptions will be omitted.

If the drive voltage V2 for the actuator unit 21 has been adjusted to a low drive voltage, the voltage level of the driving waveform output from the driver IC 74 is reduced, so the amount of ink to be ejected from the ejection opening 108 is made smaller than the ideal amount of ink to be ejected. In an image formation operation, if ink continues to be ejected from the ejection openings 108 corresponding to the actuators in each actuator unit 21 for which the drive voltage V2 has been adjusted to a low drive voltage, the viscosity of the ink in the ejection opening 108 is lowered. Therefore, the amount of ink to be ejected from the ejection opening 108 comes close to the ideal amount of ink to be ejected.

In this embodiment, only at the start of an image formation operation at which the image quality of an image formed on the paper P may be deteriorated because the amount of ink to be ejected from the ejection opening 108 is not close to the ideal amount of ink to be ejected. Consequently, the driving waveform output from the relevant driver IC 74 to the actuators included in an actuator unit 21 for which the drive voltage V2 is adjusted to a low drive voltage is set to a large ejection driving waveform. For example, when the driving waveform output according to image data stored in the image data storage device 151 is a driving waveform corresponding to the medium liquid droplet ejection mode, a driving waveform corresponding to the large liquid droplet ejection mode is output. When the driving waveform output according to image data stored in the image data storage device 151 is a driving waveform corresponding to the small liquid droplet ejection mode, a driving waveform corresponding to the medium or large liquid droplet ejection mode is output. When the driving waveform output according to image data stored in the image data storage device 151 is a driving waveform corresponding to the large liquid droplet ejection mode, the driving waveform corresponding to the large liquid droplet ejection mode is output without alternation.

Specifically, at an initial time in the image formation operation, the head controller 159 sends selection data to a driver IC 74 corresponding to each actuator unit 21 for which the drive voltage V2 is adjusted to a low drive voltage in the above drive voltage adjustment processing by the drive voltage controller 157, wherein the driver IC 74 selects ejection waveform data according to which a larger amount of ink is ejected (droplets with a larger volume are ejected) when compared with a case in which the ejection waveform data is selected by the driver IC 74 according to image data stored in the image data storage device 151 (the selection data will be referred to below as the large ejection selection data). Thus, the driver IC 74 creates a large ejection driving waveform corresponding to a larger amount of ink to be ejected than the amount of ink to be ejected corresponding to the driving waveform created according to image data stored in the image data storage device 151.

After that, when in the actuator unit 21 for which the drive voltage V2 has been adjusted to a low drive voltage, ink is ejected from the ejection openings 108 corresponding to the actuators in the actuator unit 21, and the calculation result obtained from the liquid viscosity calculating unit 153 for the viscosity of the ink in the ejection openings 108 corresponding to the actuator unit 21 thereby matches the ink viscosity according to which the low drive voltage is determined by the drive voltage determining unit 154 as the drive voltage V2 to be supplied to the actuator unit 21. The head controller 159 changes selection data to be sent to the driver IC 74 from the large ejection selection data to the basic selection data and sends the large ejection selection data. In subsequent image formation operations, the driver IC 74 creates driving waveforms according to image data stored in the image data storage device 151.

A time at which the selection data to be sent from the head controller 159 to the driver IC 74 is changed from the large ejection selection data to the basic selection data is a time at which the paper P to which ink is ejected from the head 1 is changed. Thus, when a driving waveform is changed while an image is being formed on the same paper P, it is possible to prevent deterioration of the image quality of the image formed on the paper P.

Next, an example of the operation of the printer 101 in this embodiment will be described with reference to FIG. 8. Processing in steps B1 to B13 is substantially the same as processing in A1 to A23 described above, so its explanation will be omitted.

Upon completion of processing in step B13, the main voltage determining unit 155 adjusts the main voltage based on low drive voltage (B14). Upon completion of processing in step B14, the head controller 159 and conveyance controller 160 start an image formation operation (B15). Specifically, the conveyance controller 160 controls the operations of the paper feed mechanism 30, feed roller pairs 14 and 28, and conveyance mechanism 16 so that the paper P is conveyed at a predetermined conveyance speed in the conveyance direction. The head controller 159 sends the four types of ejection waveform data to each of the driver ICs 74. The head controller 159 also sends basic selection data to each of the driver ICs 74 corresponding to actuator units 21 other than the actuator units 21 for which the drive voltage V2 has been adjusted to a low drive voltage or high drive voltage. The head controller 159 sends small ejection selection data to the driver ICs 74 corresponding to the actuator units 21 for which the drive voltage V2 has been adjusted to a high drive voltage, and sends large ejection selection data to the driver ICs 74 corresponding to the actuator units 21 for which the drive voltage V2 has been adjusted to a low drive voltage. Thus, in the driver ICs 74 corresponding to the actuator units 21 other than the actuator units 21 for which the drive voltage V2 has been adjusted to a high drive voltage or low drive voltage, driving waveforms are created according to image data stored in the image data storage device 151. In the driver IC 74 corresponding to each actuator unit 21 for which the drive voltage V2 has been adjusted to a high drive voltage, a small ejection driving waveform is created. In the driver IC 74 corresponding to each actuator unit 21 for which the drive voltage V2 has been adjusted to a low drive voltage, a large ejection driving waveform is created. As a result, it is possible to suppress deterioration of the image quality of an image formed on the paper P.

Next, the head controller 159 decides whether all images involved in image data stored in the image data storage device 151 have been formed on the paper P (B16). If the head controller 159 decides that all images have been formed on the paper P (the result in step B16 is Yes), the processing by the printer 101 is terminated. If the head controller 159 decides that all images have not been formed on the paper P (the result in step B16 is No), the head controller 159 decides whether the calculation result obtained from the liquid viscosity calculating unit 153 for the viscosity of the ink in the ejection openings 108 corresponding to the actuator unit 21 for which the drive voltage V2 has been adjusted to a low drive voltage matches the ink viscosity according to which the low drive voltage is determined by the drive voltage determining unit 154 as the drive voltage V2 to be supplied to the actuator unit 21 (B17). If the head controller 159 decides that the calculation result obtained from the liquid viscosity calculating unit 153 does not match the ink viscosity according to which the low drive voltage is determined (the result in step B17 is No), the sequence returns to step B15. If the head controller 159 decides that the calculation result obtained from the liquid viscosity calculating unit 153 matches the ink viscosity according to which the low drive voltage is determined (the result in step B17 is Yes), the head controller 159 decides whether the paper P on which to eject ink from the head 1 has been changed (B18). If the head controller 159 decides that the paper P on which to eject ink from the head 1 has not been changed (the result in step B18 is No), processing in step B19 is repeated until image formation operation for the paper P taken as the current target to which to eject ink is completed. If the head controller 159 decides that the paper P on which to eject ink has been changed (the result in step B18 is Yes), the head controller 159 changes selection data to be sent to the driver IC 74 corresponding to the actuator unit 21 for which the drive voltage V2 has been adjusted to a low drive voltage from the large ejection selection data to the basic selection and sends the basic selection data (B19). In subsequent image formation operation, the driver IC 74 corresponding to the actuator unit 21 for which the drive voltage V2 has been adjusted to a low drive voltage creates driving waveforms according to image data stored in the image data storage device 151. As a result, an ideal amount of ink is ejected from the ejection openings 108, so it is possible to further suppress deterioration of the image quality of an image formed on the paper P. Upon completion of the processing in step B19, the processing by the printer 101 is terminated.

Although, in this embodiment, ink is hard to eject from the ejection openings 108 corresponding to the actuators in the actuator unit 21 for which the drive voltage V2 is adjusted to a low drive voltage, the driving waveform by which the actuator is driven is a large ejection driving waveform by which much ink is ejected from the ejection openings 108. As a result, it is possible to suppress deterioration of the image quality of an image formed on the paper P.

Furthermore, if the viscosity of the ink in the ejection openings 108 corresponding to the actuators in the actuator unit 21 for which the drive voltage V2 is adjusted to a low drive voltage falls to a viscosity according to which the drive voltage determining unit 154 determines a low drive voltage, a driving waveform created according to image data stored in the image data storage device 151 is output to the actuators in the actuator unit 21. As a result, an ideal amount of ink is ejected from the ejection openings 108, so it is possible to reliably suppress deterioration of the image quality of an image formed on the paper P.

While the disclosure has been described in detail with reference to specific embodiments thereof, these are merely examples, and various changes, arrangements and modifications may be applied therein without departing from the spirit and scope of the disclosure. For example, although maintenance operation performed for the head 1 by the maintenance controller 161 has been a purge operation in the above embodiments, the maintenance operation may be a flushing operation by which ink is forcibly ejected from the ejection openings 108 by driving the actuators in the head 1.

In the above embodiments, adjustment of the main voltage V1 has been made possible by the switching regulator 76 controlled by the main voltage controller 158, the main voltage V1 may be left unchanged. In this case, if the voltage difference between the drive voltage V2 and the main voltage V1 is made lower than or equal to the allowable value for all actuator units 21, it suffices for the drive voltage controller 157 to perform only drive voltage adjustment processing. Although, in the above embodiments, each actuator unit 21 has been structured with a plurality of actuators, it may be structured with at least one actuator.

Although, in the above embodiments, it has been made possible for the driver IC 74 to create four types of driving waveforms, it suffices for the driver IC 74 to be operable to create at least three types of driving waveforms that correspond to three types of election modes, which are the non-ejection mode and two types of ejection modes in which droplets with different volumes are ejected.

Although, in the above embodiments, the amount of drive voltage V2 adjustment in drive voltage adjustment processing by the drive voltage controller 157 has been set according to a driving waveform created by the driver IC 74, the driver IC 74 may be operable to create a driving waveform according to the amount of drive voltage V2 adjustment in drive voltage adjustment processing by the drive voltage controller 157. That is, the driver IC 74 may be structured so that a driving waveform used for adjustment is created besides the above four types of driving waveforms.

Although, in the above embodiments, droplets with four sizes (four-level tone) have been ejected from the ejection opening 108, any other tone may be used. The more tone levels that exist, the more appropriately the large ejection driving waveform and small ejection driving waveform can be selected and a low drive voltage and high drive voltage can be adjusted. Although, in the above embodiments, the amount of voltage by which the ideal drive voltage V2 is adjusted to a high drive voltage or low drive voltage has been determined according to the relevant small ejection driving waveform or large ejection driving waveform, the amount of voltage adjustment may have been set to a certain value and a small ejection driving waveform or large ejection driving waveform may be selected so that the actual amount of ink to be ejected comes close to the ideal amount of ink to be ejected. That is, if a small ejection driving waveform or large ejection driving waveform can be selected so as to correct the problem that the amount of ink to be ejected deviates from the ideal amount of ink to be ejected as the result of adjusting the ideal drive voltage V2 to a high drive voltage or low drive voltage, the amount of voltage adjustment does not need to be strictly set.

Although, in the above embodiments, the ink viscosity involved in each actuator unit 21 has been the highest of the viscosities of the inks in the ejection openings 108 corresponding to the actuators in the actuator unit 21, the ink viscosity may be the average of the viscosities of the inks in the ejection openings 108 corresponding to the actuators in the actuator unit 21.

Although the controller 100 has been structured with a single CPU, it may have a combination of a plurality of CPUs. Alternatively, a CPU and an application-specific integrated circuit (ASIC) may be combined.

The disclosure may be applied to a serial inkjet printer. The disclosure also may be applied to a liquid ejection apparatus that performs recording by ejecting a liquid other than inks. The recording medium is not limited to the paper P. Various recordable media may be used.

What is claimed is:

1. A liquid ejection apparatus comprising:

a liquid ejection head comprising a plurality of ejection openings from which a liquid is ejected, and a plurality of actuators, each of which corresponds to one of the plurality of ejection openings, each actuator being configured to eject the liquid from the ejection opening corresponding to each actuator;

a storage device configured to store image data related to the image to be recorded on a recording medium;

a power supply configured to output a main voltage;

a plurality of linear regulators, each linear regulator corresponding to one of a plurality of actuator units, each actuator unit having at least one of the plurality of actuators, each linear regulator being configured to reduce the main voltage output from the power supply to a drive voltage used by the actuator unit corresponding to the linear regulator and supply the drive voltage to the actuator unit corresponding to the linear regulator; and a control device configured to:

calculate a viscosity of the liquid in the plurality of ejection openings corresponding to at least one actuator for each of the plurality of actuator units;

determine, for each of the plurality of actuator units, the drive voltage which is output to the actuator unit corresponding to the linear regulator based on the viscosity of the liquid;

judge whether a voltage difference between the drive voltage and the main voltage is greater than a first value for each of the plurality of actuator units;

adjust the drive voltage to a higher drive voltage for each of the plurality of actuator units when the voltage difference is greater than the first value, in order to reduce the voltage difference to be equal to or lower than the first value;

create a plurality of different types of driving waveforms based on the image data, each driving waveform having a voltage level corresponding to the drive voltage of the actuator unit in which the plurality of actuators are included, wherein different amounts of liquid are ejected from the plurality of ejection openings corresponding to the plurality of actuators according to the different types of driving waveforms, and a small ejection driving waveform, which is one of the plurality of different types of driving waveforms, is created and output to the actuator included in the actuator unit, among the plurality of actuator units, for which the drive voltage is adjusted to the higher drive voltage, and the small ejection driving waveform is used to eject a smaller amount of liquid than an amount of liquid ejected based on the driving waveforms created from the image data;

control the plurality of linear regulators to supply the drive voltage or the higher drive voltage to the plurality of actuator units; and output the plurality of different types of driving waveforms to each of the plurality of actuators.

2. The liquid ejection apparatus according to claim 1, wherein the control device is further configured to determine the main voltage based on a maximum drive voltage, which is a highest drive voltage among the drive voltages; and control the power supply to output the main voltage.

3. The liquid ejection apparatus according to claim 2, wherein the control device is further configured to:

adjust the maximum drive voltage to a low drive voltage, which is a drive voltage lower than the maximum drive voltage, when the voltage difference is greater than the first value for any of the plurality of actuator units;

adjust the main voltage to an adjusted main voltage based on the maximum drive voltage;

create the plurality of different types of driving waveforms based on the image data;

control the power supply to output the adjusted main voltage;

control the plurality of linear regulators to supply one of the drive voltage, the higher drive voltage and the low drive voltage to the plurality of actuator units; and output the plurality of different types of driving waveforms to each of the plurality of actuators.

4. The liquid ejection apparatus according to claim 3, wherein the control device is configured to create a large ejection driving waveform, to be output to the actuator included in the actuator unit, among the plurality of actuator units, for which the drive voltage is reduced to the low drive voltage, the large ejection driving waveform being used to eject a larger amount of liquid than an amount of liquid ejected based on the driving waveforms created from the image data.

5. The liquid ejection apparatus according to claim 4, wherein when in the actuator unit for which the drive voltage has been reduced to the low drive voltage, liquid is ejected from the ejection opening corresponding to the actuator in the actuator unit and a calculation result obtained for a viscosity of the liquid in the ejection opening corresponding to the actuator unit thereby matches the liquid viscosity according to which the low drive voltage is determined by the control device as the drive voltage to be supplied to the actuator unit, the control device is configured to create the driving waveform based on the image data stored as the driving waveform to be output to the actuator in the actuator unit, among the plurality of actuator units, for which the drive voltage has been reduced to the low drive voltage, instead of creating the large ejection driving waveform.

6. The liquid ejection apparatus according to claim 5, wherein a time at which the control device changes the driving waveform created as the driving waveform to be output to the actuator in the actuator unit for which the drive voltage has been reduced to the low drive voltage from the large ejection driving waveform to the driving waveform created based on the image data is a time at which a recording medium to which liquid is ejected from the liquid ejection head is changed.

7. The liquid ejection apparatus according to claim 1, further comprising a maintenance mechanism configured to perform maintenance of the liquid ejection head, wherein the control device is configured to judge for each of the plurality of actuator units whether the voltage difference is greater than a second value, which is larger than the first predetermined value, when the voltage difference is greater than the second value for any of the plurality of actuator units, the control device is configured to control the maintenance mechanism to perform maintenance for the liquid ejection head to reduce the voltage difference to be equal to or lower than the first value for all of the plurality of actuator units, and the control device is configured to control the plurality of linear regulators to supply the drive voltages to the plurality of actuator units.

8. The liquid ejection apparatus according to claim 1, wherein the power supply has a switching regulator and the control device is further configured to control the switching regulator to output the main voltage.

9. A method for controlling a liquid ejection apparatus comprising the steps of:

calculating, for each of a plurality of actuator units, a viscosity of the liquid in a plurality of ejection openings corresponding to a plurality of actuators, wherein at least one actuator is included in each of the plurality of actuator units;

determining, for each of the plurality of actuator units, a drive voltage which is output to the actuator unit based on the viscosity of the liquid;

judging, for each of the plurality of actuator units, whether a voltage difference between the drive voltage and a main voltage output from a power supply is greater than a first value;

adjusting, for each of the plurality of actuator units, the drive voltage to a higher drive voltage to reduce the voltage difference to be equal to or lower than the first value when the voltage difference is greater than the first value;

creating a plurality of different types of driving waveforms based on image data, each driving waveform having a voltage level corresponding to the drive voltage of the actuator unit in which the plurality of actuators are included, wherein different amounts of liquid are ejected from the plurality of ejection openings corresponding to the plurality of actuators according to the different types of driving waveforms, and a small ejection driving waveform, which is one of the plurality of different types of driving waveforms, is created and output to the actuator included in the actuator unit, among the plurality of actuator units, for which the drive voltage is adjusted to the higher drive voltage, and the small ejection driving waveform is used to eject a smaller amount of liquid than an amount of liquid ejected based on the driving waveforms created from the image data;

controlling a plurality of linear regulators, each of which corresponds to one of the plurality of actuator units, to supply the drive voltage or the higher drive voltage to the plurality of actuator units; and outputting the plurality of different types of driving waveforms to each of the plurality of actuators.

10. A non-transitory computer-readable storage medium storing computer-readable instructions therein that, when executed by at least one processor of a liquid ejection apparatus, instructs the liquid ejection apparatus to execute the steps of:

calculating, for each of a plurality of actuator units, a viscosity of liquid in a plurality of ejection openings corresponding to a plurality of actuators, wherein at least one actuator is included in each of the plurality of actuator units;

determining, for each of the plurality of actuator units, a drive voltage which is output to the actuator unit based on the viscosity of the liquid;

judging, for each of the plurality of actuator units, whether a voltage difference between the drive voltage and a main voltage output from a power supply is greater than a first value;

adjusting, for each of the plurality of actuator units, the drive voltage to a higher drive voltage to reduce the voltage difference to be equal to or lower than the first value when the voltage difference is greater than the first value;

creating a plurality of different types of driving waveforms based on image data, each driving waveform having a voltage level corresponding to the drive voltage of the actuator unit in which the plurality of actuators are included, wherein different amounts of liquid are ejected from the plurality of ejection openings corresponding to the plurality of actuators according to the different types of driving waveforms, and a small ejection driving waveform, which is one of the plurality of different types of driving waveforms, is created and output to the actuator included in the actuator unit, among the plurality of actuator units, for which the drive voltage is adjusted to the higher drive voltage, and the small ejection driving waveform is used to eject a smaller amount of liquid than an amount of liquid ejected based on the driving waveforms created from the image data;

controlling a plurality of linear regulators, each of which corresponds to one of the plurality of actuator units, to supply the drive voltage or the higher drive voltage to the plurality of actuator units; and outputting the plurality of different types of driving waveforms to each of the plurality of actuators.

* * * * *